US008343339B2

(12) United States Patent
Sumonthee

(10) Patent No.: US 8,343,339 B2
(45) Date of Patent: Jan. 1, 2013

(54) APPARATUS FOR FACILITATING MAINTENANCE OF A POOL CLEANING DEVICE

(75) Inventor: Jirawat Sumonthee, West Palm Beach, FL (US)

(73) Assignee: Hayward Industries, Inc., Elizabeth, NJ (US)

( * ) Notice: Subject to any disclaimer, the term of this patent is extended or adjusted under 35 U.S.C. 154(b) by 258 days.

(21) Appl. No.: 12/211,720

(22) Filed: Sep. 16, 2008

(65) Prior Publication Data

US 2010/0065482 A1 Mar. 18, 2010

(51) Int. Cl.
*E04H 4/16* (2006.01)

(52) U.S. Cl. ..... 210/167.16; 210/232; 210/416.2; 15/1.7

(58) Field of Classification Search ..... 210/167.1, 210/167.15, 167.16, 232, 416.1, 416.2; 15/1.7
See application file for complete search history.

(56) References Cited

U.S. PATENT DOCUMENTS

| | | | | |
|---|---|---|---|---|
| 389,790 | A | 9/1888 | Boutell | |
| 1,639,170 | A | 8/1927 | Fell | |
| D144,063 | S | 3/1946 | McAllister | |
| D175,210 | S | 7/1955 | Dreyfuss | |
| D176,635 | S | 1/1956 | Shalvoy | |
| 2,751,038 | A | 6/1956 | Acheson | |
| D186,872 | S | 12/1959 | Swann | |
| 3,039,122 | A | 6/1962 | Birdsall | |
| 3,310,173 | A | 3/1967 | Sosower | |
| 3,321,787 | A | 5/1967 | Myers | |
| 3,324,492 | A | 6/1967 | Myers | |
| 3,337,889 | A | 8/1967 | West | |
| 3,347,386 | A | 10/1967 | Kraissl, Jr. | |
| 3,439,368 | A | 4/1969 | Myers | |
| RE26,741 | E | 12/1969 | Myers | |
| 3,551,930 | A | 1/1971 | Myers | |
| 3,665,942 | A | 5/1972 | Moore | |
| 3,688,908 | A | 9/1972 | Myers et al. | |
| 3,689,408 | A | 9/1972 | Edmiston et al. | |
| 3,767,055 | A | 10/1973 | Flatland | |
| 3,794,052 | A | 2/1974 | Koble, Jr. et al. | |
| 3,797,508 | A | 3/1974 | Jacobs | |
| 3,805,815 | A | 4/1974 | Goodin | |
| 3,822,754 | A | 7/1974 | Henkin et al. | |
| 3,868,739 | A * | 3/1975 | Hargrave | 15/1.7 |
| 3,886,616 | A | 6/1975 | Hayes | |

(Continued)

FOREIGN PATENT DOCUMENTS

AU 704603 1/1997

(Continued)

OTHER PUBLICATIONS

Tiger Shark Owner's Manual (Mar. 2007) (16 pages).

(Continued)

*Primary Examiner* — Fred Prince
(74) *Attorney, Agent, or Firm* — McCarter & English, LLP

(57) ABSTRACT

Advantageous apparatus, are provided for facilitating maintenance of a automated pool cleaning device. More particularly, an improved automated pool cleaning device is provided, according to the present disclosure. The device, generally, includes a facially accessible quick-release roller assembly, a bucket-type filter assembly, and a windowed top access lid assembly. The improved roller assembly and filter assembly are easily accessible for maintenance purposes. Furthermore, the windowed lid assembly provides visual feedback as to when the filter assembly needs to be cleaned.

38 Claims, 21 Drawing Sheets

U.S. PATENT DOCUMENTS 3,921,654 A 11/1975 Pansini
3,936,899 A 2/1976 Henkin et al.
3,972,339 A 8/1976 Henkin et al.
3,979,788 A 9/1976 Strausak
4,009,675 A 3/1977 Zöllner et al.
4,040,864 A 8/1977 Steeves
4,152,802 A 5/1979 Chauvier
4,154,680 A 5/1979 Sommer
4,156,948 A 6/1979 Chauvier et al.
4,168,557 A 9/1979 Rasch et al.
4,193,156 A 3/1980 Chauvier
4,240,174 A * 12/1980 Thiem et al. ..... 15/1.7
4,281,995 A 8/1981 Pansini
4,306,329 A 12/1981 Yokoi
D264,797 S 6/1982 Burglin et al.
4,338,697 A 7/1982 Broadwater
4,351,077 A 9/1982 Hofmann
4,402,101 A 9/1983 van Zyl
4,431,538 A 2/1984 Selsted
4,533,945 A 8/1985 Lauvray et al.
4,558,479 A 12/1985 Greskovics et al.
4,575,423 A 3/1986 Alanis et al.
4,589,986 A 5/1986 Greskovics et al.
4,618,420 A 10/1986 Alanis
4,645,593 A 2/1987 Dunk et al.
4,651,376 A 3/1987 Ford
4,652,366 A 3/1987 Brooks
4,692,956 A 9/1987 Kassis
4,761,848 A 8/1988 Hofmann
4,768,532 A 9/1988 Johnson
4,769,867 A 9/1988 Stoltz
4,776,953 A 10/1988 Frentzel
4,776,954 A 10/1988 Brooks
4,778,599 A 10/1988 Brooks
4,802,592 A 2/1989 Wessels
4,807,318 A 2/1989 Kallenbach
4,839,063 A 6/1989 Brooks
4,849,024 A 7/1989 Supra
D304,505 S 11/1989 Maier et al.
4,950,393 A 8/1990 Goettl
4,959,146 A * 9/1990 Kristan ..... 210/237
4,962,559 A 10/1990 Schuman
4,994,178 A 2/1991 Brooks
D315,624 S 3/1991 Kimura et al.
5,014,382 A 5/1991 Kallenbach
5,093,950 A 3/1992 Heier
5,099,535 A 3/1992 Chauvier et al.
D325,452 S 4/1992 Gefter
D325,796 S 4/1992 Kallenbach
5,105,496 A 4/1992 Gray, Jr. et al.
5,133,503 A 7/1992 Giordano et al.
5,133,854 A 7/1992 Horvath
D328,778 S 8/1992 Gefter et al.
5,143,605 A 9/1992 Masciarelli
D330,582 S 10/1992 Gefter et al.
5,169,236 A 12/1992 Iest
5,172,445 A 12/1992 Chandler
5,197,158 A 3/1993 Moini
5,226,205 A 7/1993 Pearce
5,265,297 A 11/1993 Gould et al.
5,269,913 A 12/1993 Atkins
D346,888 S 5/1994 Stone
D349,150 S 7/1994 Ruiz
5,329,648 A 7/1994 Davey
5,337,434 A 8/1994 Erlich
5,342,513 A 8/1994 Wall et al.
5,351,355 A 10/1994 Chiniara
5,352,358 A 10/1994 Davey
5,364,512 A 11/1994 Earl
5,398,362 A 3/1995 Chauvier
5,412,826 A 5/1995 Raubenheimer
5,435,031 A 7/1995 Minami et al.
D361,178 S 8/1995 Piret
5,450,644 A 9/1995 Berman
5,450,645 A 9/1995 Atkins
5,454,129 A 10/1995 Kell
5,507,058 A 4/1996 Minami et al.
D373,230 S 8/1996 Sebor et al.
5,546,982 A 8/1996 Clark et al.
5,554,277 A 9/1996 Rief et al.
5,569,371 A 10/1996 Perling
D375,592 S 11/1996 Ljunggren
D376,450 S 12/1996 Campbell et al.
5,603,135 A 2/1997 Jones et al.
5,604,950 A 2/1997 Stern
5,617,600 A 4/1997 Frattini
5,634,229 A 6/1997 Stoltz
5,645,721 A 7/1997 Carroll, Jr.
D384,782 S 10/1997 Gefter
5,681,110 A 10/1997 Burzacchi
5,720,068 A 2/1998 Clark et al.
5,771,987 A 6/1998 Marbach
5,788,850 A 8/1998 Tuomey
5,802,653 A 9/1998 Roumagnac
5,810,999 A 9/1998 Bachand et al.
D400,319 S 10/1998 Hofheins et al.
5,830,350 A 11/1998 Voss et al.
5,842,243 A 12/1998 Horvath et al.
5,863,425 A 1/1999 Herlehy et al.
5,882,512 A 3/1999 Denkewicz, Jr. et al.
D408,104 S 4/1999 Adam
5,893,188 A 4/1999 Campbell et al.
5,930,856 A 8/1999 Van Der Meyden et al.
5,933,899 A 8/1999 Campbell et al.
5,935,179 A 8/1999 Kleiner et al.
5,961,822 A 10/1999 Polimeni, Jr.
D417,322 S 11/1999 Hollinger
5,985,156 A 11/1999 Henkin et al.
5,996,906 A 12/1999 Cooper
6,003,184 A 12/1999 Campbell et al.
D418,640 S 1/2000 Veloskey et al.
6,013,178 A 1/2000 Strano et al.
D421,512 S 3/2000 Campbell
6,039,886 A 3/2000 Henkin et al.
6,049,933 A 4/2000 McLaughlin
6,090,219 A 7/2000 Henkin et al.
D430,368 S 8/2000 Porat et al.
6,094,764 A 8/2000 Veloskey et al.
6,099,658 A 8/2000 Porat
D430,960 S 9/2000 van der Meyden et al.
D430,962 S 9/2000 Porat et al.
6,112,354 A 9/2000 Stoltz et al.
6,115,864 A 9/2000 Davidsson et al.
6,119,293 A 9/2000 Phillipson et al.
6,119,707 A 9/2000 Jordan
6,125,492 A 10/2000 Prowse
D433,545 S 11/2000 Hollinger et al.
6,155,657 A 12/2000 Erlich et al.
D436,700 S 1/2001 Forbes et al.
6,193,885 B1 2/2001 Campbell
6,200,487 B1 3/2001 Denkewicz, Jr. et al.
6,206,547 B1 3/2001 Erlich
6,212,725 B1 4/2001 Porat
6,238,553 B1 5/2001 Lin
D445,225 S 7/2001 Schaub
6,280,611 B1 8/2001 Henkin et al.
6,294,084 B1 9/2001 Henkin et al.
6,299,699 B1 10/2001 Porat et al.
6,309,468 B1 10/2001 Sommer
6,311,353 B1 11/2001 Phillipson et al.
6,357,478 B1 3/2002 Campbell et al.
6,365,039 B1 4/2002 Henkin et al.
6,387,250 B1 5/2002 Henkin et al.
6,398,878 B1 6/2002 Henkin et al.
6,409,916 B1 6/2002 Zelas et al.
6,412,133 B1 7/2002 Erlich et al.
D463,889 S 10/2002 Buzzi
6,473,927 B1 11/2002 Sommer
6,485,638 B2 11/2002 Henkin et al.
D469,589 S 1/2003 Wichmann et al.
6,502,269 B1 1/2003 Balchan et al.
D471,330 S 3/2003 Campbell
D474,312 S 5/2003 Stephens et al.
6,564,417 B2 5/2003 Porat
6,601,255 B1 8/2003 van der Meyden et al.
6,627,074 B2 9/2003 Lincke
D481,181 S 10/2003 Lath et al.

| | | | |
|---|---|---|---|
| 6,645,375 | B2 | 11/2003 | Henkin et al. |
| 6,652,742 | B2 | 11/2003 | Henkin et al. |
| 6,665,900 | B2 | 12/2003 | Wichmann et al. |
| RE38,479 | E | 3/2004 | Henkin et al. |
| 6,725,489 | B1 | 4/2004 | Zell |
| 6,740,233 | B2 | 5/2004 | Stoltz et al. |
| 6,742,613 | B2 | 6/2004 | Erlich et al. |
| 6,751,822 | B2 | 6/2004 | Phillipson et al. |
| 6,758,226 | B2 | 7/2004 | Porat |
| 6,802,963 | B2 | 10/2004 | Campbell |
| 6,815,918 | B2 | 11/2004 | Porat et al. |
| 6,842,931 | B2 | 1/2005 | Porat et al. |
| 6,886,205 | B1 | 5/2005 | Pichon |
| 6,942,790 | B1 | 9/2005 | Dolton |
| 6,954,960 | B2 | 10/2005 | Pichon |
| 6,965,814 | B2 | 11/2005 | Hadari |
| 6,971,136 | B2 | 12/2005 | Horvath et al. |
| 6,979,400 | B2 | 12/2005 | Bauckman et al. |
| 7,001,159 | B2 | 2/2006 | Peterson, Jr. et al. |
| 7,039,980 | B2 | 5/2006 | Van Der Meyden et al. |
| D524,495 | S | 7/2006 | Ljunggren |
| D526,101 | S | 8/2006 | Blanc-Tailleur |
| 7,089,876 | B2 | 8/2006 | Porat |
| 7,103,449 | B2 | 9/2006 | Woo et al. |
| D529,669 | S | 10/2006 | Blanc-Tailleur |
| 7,117,554 | B2 | 10/2006 | Pichon |
| 7,118,632 | B2 | 10/2006 | Sumonthee |
| 7,118,678 | B2 | 10/2006 | Porat |
| 7,143,502 | B2 | 12/2006 | Porat et al. |
| 7,145,074 | B2 | 12/2006 | Henkin et al. |
| 7,165,284 | B2 | 1/2007 | Erlich et al. |
| D537,576 | S | 2/2007 | Koury et al. |
| 7,207,604 | B2 | 4/2007 | Wilson |
| 7,208,083 | B2 | 4/2007 | Meritt-Powell |
| 7,213,287 | B2 | 5/2007 | Hui |
| D550,906 | S | 9/2007 | Fritz et al. |
| 7,273,546 | B2 | 9/2007 | Meritt-Powell |
| 7,316,751 | B2 | 1/2008 | Horvath et al. |
| 7,318,448 | B2 | 1/2008 | Fleischer et al. |
| 7,395,571 | B2 | 7/2008 | Van Der Meijden et al. |
| D575,915 | S | 8/2008 | Dreyer |
| 7,501,056 | B2 | 3/2009 | Henkin et al. |
| 7,504,025 | B2 | 3/2009 | Burgassi |
| 7,507,332 | B2 | 3/2009 | Henkin et al. |
| 7,515,991 | B2 | 4/2009 | Egawa et al. |
| 7,543,607 | B2 | 6/2009 | Henkin et al. |
| D598,168 | S | 8/2009 | Sumonthee |
| 7,575,675 | B2 | 8/2009 | Gopalan |
| D599,967 | S | 9/2009 | Blanc-Tailleur |
| 7,661,381 | B2 | 2/2010 | Gorelik et al. |
| 7,677,268 | B2 | 3/2010 | Griffin et al. |
| 7,682,461 | B2 | 3/2010 | Sommer et al. |
| 7,690,066 | B2 | 4/2010 | Stoltz et al. |
| 7,721,370 | B2 | 5/2010 | Gopalan |
| 7,723,934 | B2 | 5/2010 | Adam et al. |
| 7,786,381 | B2 | 8/2010 | Henkin et al. |
| 7,827,643 | B2 | 11/2010 | Erlich et al. |
| D630,808 | S | 1/2011 | Dye et al. |
| D630,809 | S | 1/2011 | Dye et al. |
| 7,900,308 | B2 | 3/2011 | Erlich et al. |
| 7,908,697 | B2 | 3/2011 | Lavabre et al. |
| 2002/0104790 | A1* | 8/2002 | Lincke ..... 210/169 |
| 2002/0116772 | A1 | 8/2002 | Phillipson et al. |
| 2003/0177594 | A1 | 9/2003 | Van Der Meyden et al. |
| 2004/0007522 | A1 | 1/2004 | Garti |
| 2004/0021439 | A1 | 2/2004 | Porat et al. |
| 2004/0025268 | A1 | 2/2004 | Porat et al. |
| 2004/0074524 | A1* | 4/2004 | Horvath et al. ..... 134/22.18 |
| 2004/0216251 | A1 | 11/2004 | Van Der Meijden et al. |
| 2005/0029177 | A1 | 2/2005 | Peterson et al. |
| 2005/0123408 | A1 | 6/2005 | Koehl |
| 2005/0279682 | A1 | 12/2005 | Davidson et al. |
| 2006/0054229 | A1 | 3/2006 | van der Meijden et al. |
| 2006/0059637 | A1 | 3/2006 | Fridman et al. |
| 2006/0085929 | A1 | 4/2006 | Deklinski |
| 2006/0101596 | A1 | 5/2006 | Hui et al. |
| 2006/0177325 | A1 | 8/2006 | Peterson, Jr. et al. |
| 2006/0207041 | A1 | 9/2006 | Van Der Meyden et al. |
| 2006/0225768 | A1 | 10/2006 | Erlich et al. |
| 2007/0028405 | A1 | 2/2007 | Garti |
| 2007/0056124 | A1 | 3/2007 | Wichmann et al. |
| 2007/0067930 | A1 | 3/2007 | Garti |
| 2007/0094817 | A1 | 5/2007 | Stoltz et al. |
| 2007/0251032 | A1 | 11/2007 | Pichon et al. |
| 2007/0251859 | A1 | 11/2007 | Zhu |
| 2007/0272274 | A1 | 11/2007 | Adam et al. |
| 2008/0060984 | A1 | 3/2008 | Henkin et al. |
| 2008/0078039 | A1 | 4/2008 | Katz |
| 2008/0087299 | A1 | 4/2008 | Erlich et al. |
| 2008/0099409 | A1 | 5/2008 | Gorelik et al. |
| 2008/0128343 | A1 | 6/2008 | Garti |
| 2008/0202997 | A1 | 8/2008 | Davidson et al. |
| 2008/0222821 | A1 | 9/2008 | Pichon |
| 2008/0235887 | A1 | 10/2008 | Horvath et al. |
| 2008/0236628 | A1 | 10/2008 | Horvath et al. |
| 2008/0276388 | A1 | 11/2008 | Dodd |
| 2009/0045110 | A1 | 2/2009 | Garti |
| 2009/0232701 | A1 | 9/2009 | Porat |
| 2009/0255069 | A1 | 10/2009 | Hui |
| 2009/0282627 | A1 | 11/2009 | Porat |
| 2009/0301522 | A1 | 12/2009 | Abehasera et al. |
| 2010/0011521 | A1 | 1/2010 | Collins |
| 2010/0043154 | A1 | 2/2010 | Kellogg |
| 2010/0058546 | A1 | 3/2010 | Erlich |
| 2010/0122422 | A1 | 5/2010 | Hui |
| 2010/0132136 | A1 | 6/2010 | Sommer et al. |
| 2010/0306931 | A1 | 12/2010 | Garti |
| 2011/0000030 | A1 | 1/2011 | Pichon et al. |
| 2011/0000031 | A1 | 1/2011 | Pichon et al. |
| 2011/0000032 | A1 | 1/2011 | Pichon et al. |
| 2011/0000033 | A1 | 1/2011 | Pichon et al. |
| 2011/0000034 | A1 | 1/2011 | Pichon et al. |
| 2011/0000035 | A1 | 1/2011 | Pichon et al. |
| 2011/0000036 | A1 | 1/2011 | Pichon et al. |
| 2011/0005009 | A1 | 1/2011 | Pichon et al. |
| 2011/0016646 | A1 | 1/2011 | Pichon et al. |
| 2011/0020139 | A1 | 1/2011 | Pichon et al. |
| 2011/0023247 | A1 | 2/2011 | Pichon et al. |
| 2011/0047727 | A1 | 3/2011 | Pichon et al. |
| 2011/0067729 | A1 | 3/2011 | Erlich et al. |
| 2011/0088182 | A1 | 4/2011 | Hui |
| 2011/0154585 | A1 | 6/2011 | Mastio et al. |
| 2011/0154586 | A1 | 6/2011 | Mastio et al. |
| 2011/0155186 | A1 | 6/2011 | Mastio et al. |
| 2011/0162683 | A1 | 7/2011 | Mastio et al. |
| 2011/0203060 | A1 | 8/2011 | Pichon et al. |
| 2011/0302728 | A1 | 12/2011 | Sumonthee |

FOREIGN PATENT DOCUMENTS

| | | |
|---|---|---|
| DE | 3110203 | 9/1982 |
| EP | 0314259 | 5/1989 |
| EP | 0426365 | 5/1991 |
| EP | 0468876 | 1/1992 |
| EP | 0990749 | 4/2000 |
| EP | 0990750 | 2/2007 |
| EP | 1785552 | 5/2007 |
| EP | 1921229 | 5/2008 |
| EP | 1489249 | 9/2008 |
| EP | 1849934 | 9/2009 |
| FR | 2584442 | 1/1987 |
| FR | 2693499 | 1/1994 |
| FR | 2729995 | 8/1996 |
| FR | 2864129 | 6/2005 |
| WO | WO 87/00883 | 2/1987 |
| WO | WO 90/09498 | 8/1990 |
| WO | WO 99/63185 | 12/1999 |
| WO | WO03/085225 | 10/2003 |
| WO | WO2005/007998 | 1/2005 |
| WO | WO2005/118984 | 12/2005 |
| WO | WO2006/109118 | 10/2006 |
| WO | WO2006/121808 | 11/2006 |
| WO | WO2007/055960 | 5/2007 |

OTHER PUBLICATIONS

Co-Owned U.S. Appl. No. 29/324,616, entitled: "Pool Cleaner," filed on Sep. 16, 2008 (9 pages).

Digital Image of Squirrel Cleaner (more than one year prior to Sep. 16, 2008) (1 page).

Digital Image of Pool Rover Cleaner (more than one year prior to Sep. 16, 2008) (1 page).
Digital Image of Robby Cleaner (more than one year prior to Sep. 16, 2008) (1 page).
Digital Image of Dolphin Cleaner (more than one year prior to Sep. 16, 2008) (1 page).
Digital Image of Merlin Cleaner (more than one year prior to Sep. 16, 2008) (1 page.)
Digital Image of Aquabot Cleaner (more than one year prior to Sep. 16, 2008) (1 page).
Notice of Allowance dated May 4, 2009 from copending U.S. Appl. No. 29/324,616, filed Sep. 16, 2008 (7 pages).
Dolphin Cleaner photos (3 pages) and Dolphin Cleaner p. (2 pages) (Cleaner seen at a show circa Oct. 2009).
Polaris 9300 and Vortex 3 Cleaners (manuals dated Copyright 2010 and V3 cleaner seen at a show circa Oct. 2009) (125 pages.).
Translation of previously-cited FR2693499 (13 pages).
Zodiac Cybernaut Manual (dated Sep. 3, 2006) (6 pages).
DX3 and DX4 Cleaners and Related Manuals (more than one year prior to Sep. 16, 2008) (17 pages).
Picture Sheet Showing Multiple Commercial Cleaners (more than one year prior to Sep. 16, 2008) (1 page).
Picture Sheet Showing Multiple Double-Wide Cleaners (more than one year prior to Sep. 16, 2008) (1 page).
Smartpool Nitro Cleaner Manual (more than one year prior to Sep. 16, 2008) (56 pages).
AquaBot Advertisement, Pool & Spa News (Oct. 2009) (2 pages).
Wave Cleaner (cleaner seen at show circa Oct./Nov. 2008) (25 pages).
Hexagone Cleaners (more than one year prior to Sep. 16, 2008) (8 pages).
Caratti Catalog (dated 2007) (8 pages).
Brock Catalog (dated 2005) (8 pages).
Dolphin Dx2 Hybrid Advertisement (dated 2009) (2 pages).
Dolphin 2x2 (more than one year prior to Sep. 16, 2008) (8 pages).
Cleaner shown at archive.org, link for Apr. 4, 2007 (2 sheets): http://web.archive.org/web/20070404093845/http:/www.mariner-3s.com/mariner_en/produkte/navigator/navigator.php.
Office Action mailed Oct. 11, 2011 in connection with co-pending U.S. Appl. No. 29/378,304 (8 pages).
Co-owned U.S. Appl. No. 12/938,041 entitled "Pool Cleaning Device with Adjustable Buoyant Element," filed on Nov. 2, 2010 (99 pages).
Co-owned U.S. Design Appl. No. 29/378,304 entitled "Pool Cleaner" filed on Nov. 2, 2010 (8 pages).
Notice of Allowance dated Feb. 15, 2012 from co-owned U.S. Appl. No. 29/378,304 (4 pages).
Response to Office Action mailed Oct. 11, 2011 issued in connection with co-owned U.S. Appl. No. 29/378,304 (10 pages).
Notice of Abandonment mailed May 31, 2012 from co-owned U.S. Appl. No. 29/378,304 (1 page).
YouTube Video of Mopper Cleaner, http://www.youtube.com/watch?v=d8NAUWHOQCk&feature=BFa
&list=ULopZLfx7W4Po, e.g., attached screen shots (45 pages) uploaded Nov. 18, 2009.
Restriction Requirement mailed Jun. 11, 2012 issued in connection with co-pending U.S. Appl. No. 12/938,041 (6 pages).
Notice of Allowance dated Jul. 6, 2012 issued in connection with related U.S. Appl. No. 13/213,514 including Statement of Reasons for Allowance (7 pages).

* cited by examiner

APPARATUS FOR FACILITATING MAINTENANCE OF A POOL CLEANING DEVICE

FIELD OF THE INVENTION

The present disclosure generally relates to apparatus for cleaning a pool. More particularly, exemplary embodiments of the disclosure relate to apparatus for facilitating maintenance of a pool cleaning device.

BACKGROUND OF THE INVENTION

Swimming pools commonly require a significant amount of maintenance. Beyond the treatment and filtration of pool water, the bottom wall (the "floor") and side walls of a pool (the floor and the side walls collectively, the "walls" of the pool) must be scrubbed regularly. Additionally, leaves and other debris often times elude a pool filtration system and settle on the bottom of the pool. Conventional means for scrubbing and/or cleaning a pool, e.g., nets, handheld vacuums, etc., require tedious and arduous efforts by the user, which can make owning a pool a commitment.

Automated pool cleaning devices, such as the TigerShark or TigerShark 2 by AquaVac®, have been developed to routinely navigate about the pool walls, cleaning as they go. A pump system continuously circulates water through an internal filter assembly capturing debris therein. A rotating cylindrical roller (formed of foam and/or provided with a brush) can be included on the bottom of the unit to scrub the pool walls.

While an automated pool cleaning device greatly facilitates pool maintenance, the unit itself is to be maintained, such as by cleaning or replacing the filter assembly and/or roller, brush, etc. For example, maintenance and/or replacement of a brush assembly for a conventional automated pool cleaning device can be made difficult by the location of the brush assembly. Regarding filter maintenance, it is known in the art to provide filters that are bottom-accessible, e.g., accessible by a hatch/door underneath a pool cleaning device, and it is not uncommon for such devices to be flipped upside-down to enable cleaning and/or replacement of the filter. It is known to provide a top-accessible filter of the bucket-type, such as that shown in U.S. Pat. No. 6,409,916, though such appears to include a flow path for unfiltered fluid that is circuitous.

What is needed in the art is a cleaning device with enhanced ease of use to overcome these and/or other disadvantages.

SUMMARY OF THE INVENTION

The present disclosure relates to apparatus for facilitating maintenance of a pool cleaner. More particularly, an improved pool cleaner is provided, according to the present disclosure. In some embodiments, the cleaner includes a quick-release roller assembly, a bucket-type filter assembly, and/or a windowed top-access lid assembly. The quick-release roller assembly and bucket-type filter assembly are advantageously easily accessible for maintenance purposes. In some embodiments, the windowed top-access lid assembly enables the user to easily see when the filter assembly needs to be cleaned/replaced.

The quick-release roller assembly includes a roller associated with a plurality of end joints. The end joints are secured relative to the ends of the roller, e.g., by tabs, flanges, etc. The end joints are configured and dimensioned for association with mounts secured relative to drive transfer components to facilitate rotation of the roller(s).

The bucket-type filter assembly is preferably removable from the base of the pool cleaner and can include a body, a frame preferably formed integrally therewith, and one or more filter elements secured proximal the frame. The filter elements define one or more semi-permeable boundary areas, and the body of the removable filter assembly cooperates with the semi-permeable boundaries to define intake flow regions, while the semi-permeable boundaries at least partially define a vent flow region opposite the corresponding intake flow regions. A vent channel is provided for outflow of filtered water from the vent flow region. An open top face can be provided proximal the removable filter assembly and/or flow regions to provide access thereto.

The windowed top-access lid assembly generally includes a lid and a joining mechanism for removable attaching the lid to the housing assembly of the cleaner. The lid assembly may be changed between an open position and a closed position, providing access to components housed within the cleaner. The lid assembly is typically associated with an open top face of the housing assembly advantageously providing top-access to the cleaner. The lid assembly for the cleaner may, advantageously, include one or more transparent elements. It is noted that the term "transparent," as used herein, shall be interpreted broadly to encompasses transparent, translucent, semitransparent, etc. In some embodiments, the lid may be wholly or partially manufactured/constructed from a transparent material, though it is preferred that the lid assembly include one or more windows associated with the lid and allowing for visibility therethrough. When the lid assembly is in a closed position, the one or more transparent elements can be aligned over a filter assembly housed within the cleaner, and, more particularly, over one or more intake flow regions defined by the filter assembly. A user may advantageously view the state of the filter assembly, e.g., filter wear-and tear, debris content of the one or more intake flow regions, etc., without having to open the lid assembly and/or remove the filter assembly from within the cleaner.

In some aspects, a snap-lock lift hinge lid/cover is provided. The snap-lock lift hinge lid/cover facilitates easy top opening and closing by the user to remove the bucket assembly and/or for cleaning purpose. It is contemplated that the lid/cover can be attached to a housing assembly of the cleaner, while the bucket assembly is removed therefrom.

Additional features, functions and benefits of the disclosed apparatus, systems and methods will be apparent from the description which follows, particularly when read in conjunction with the appended figures.

BRIEF DESCRIPTION OF THE DRAWINGS

To assist those of ordinary skill in the art in making and using the disclosed apparatus, reference is made to the appended figures, wherein.

DETAILED DESCRIPTION OF EXEMPLARY EMBODIMENTS

According to the present disclosure, advantageous apparatus are provided for facilitating maintenance of a pool cleaning device. More particularly, the present disclosure, includes, but is not limited to, discussion of a windowed top-access lid assembly for a pool cleaner, a bucket-type filter assembly for a pool cleaner, and quick-release roller assembly for a pool cleaner.

Figure 1:
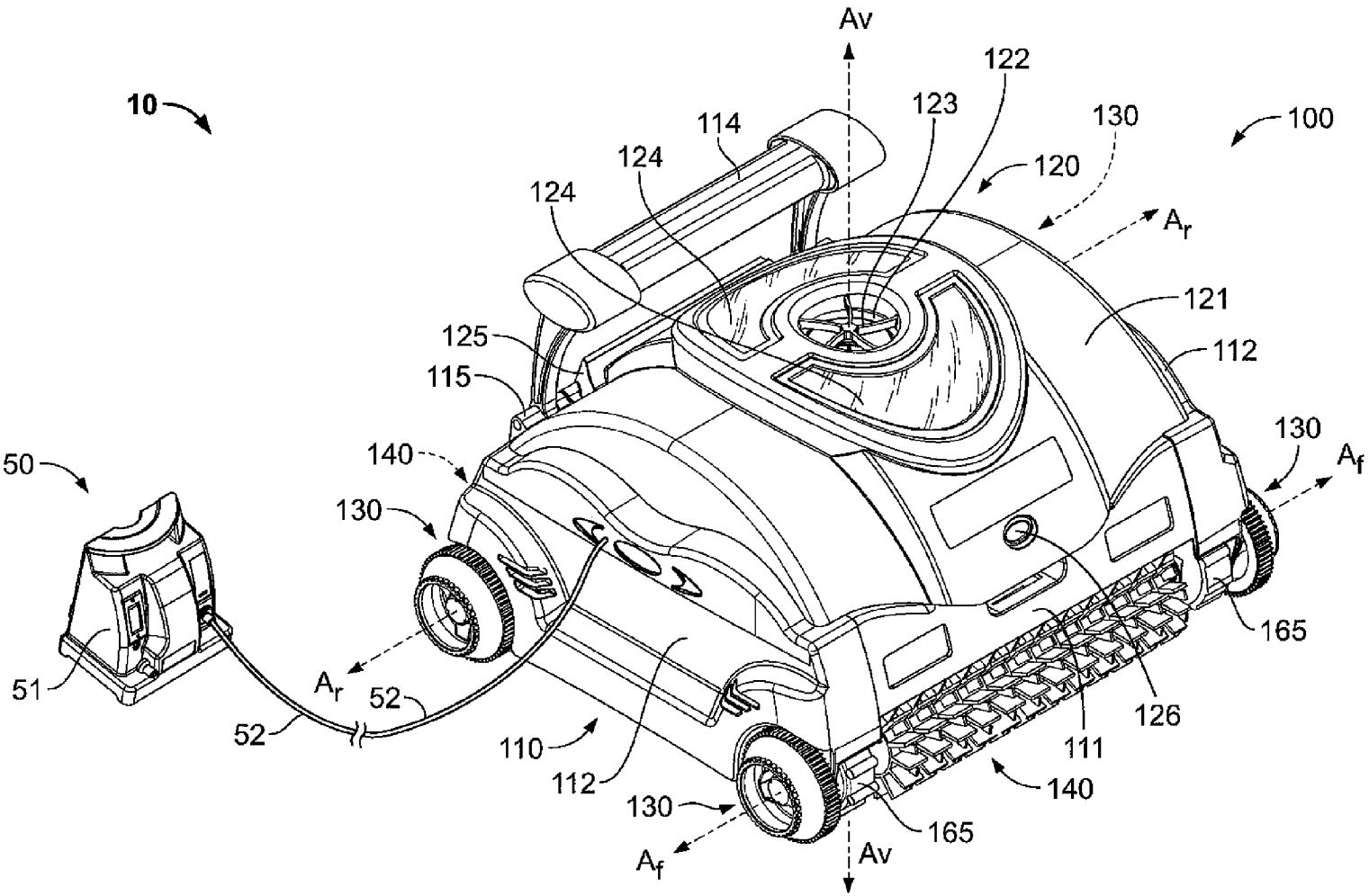
FIG. 1 depicts a front perspective view of an exemplary cleaner assembly having a cleaner and a power supply, the cleaner including a housing assembly, a lid assembly, a plurality of wheel assemblies, a plurality of roller assemblies, a motor drive assembly, and a filter assembly.
Figure 2:
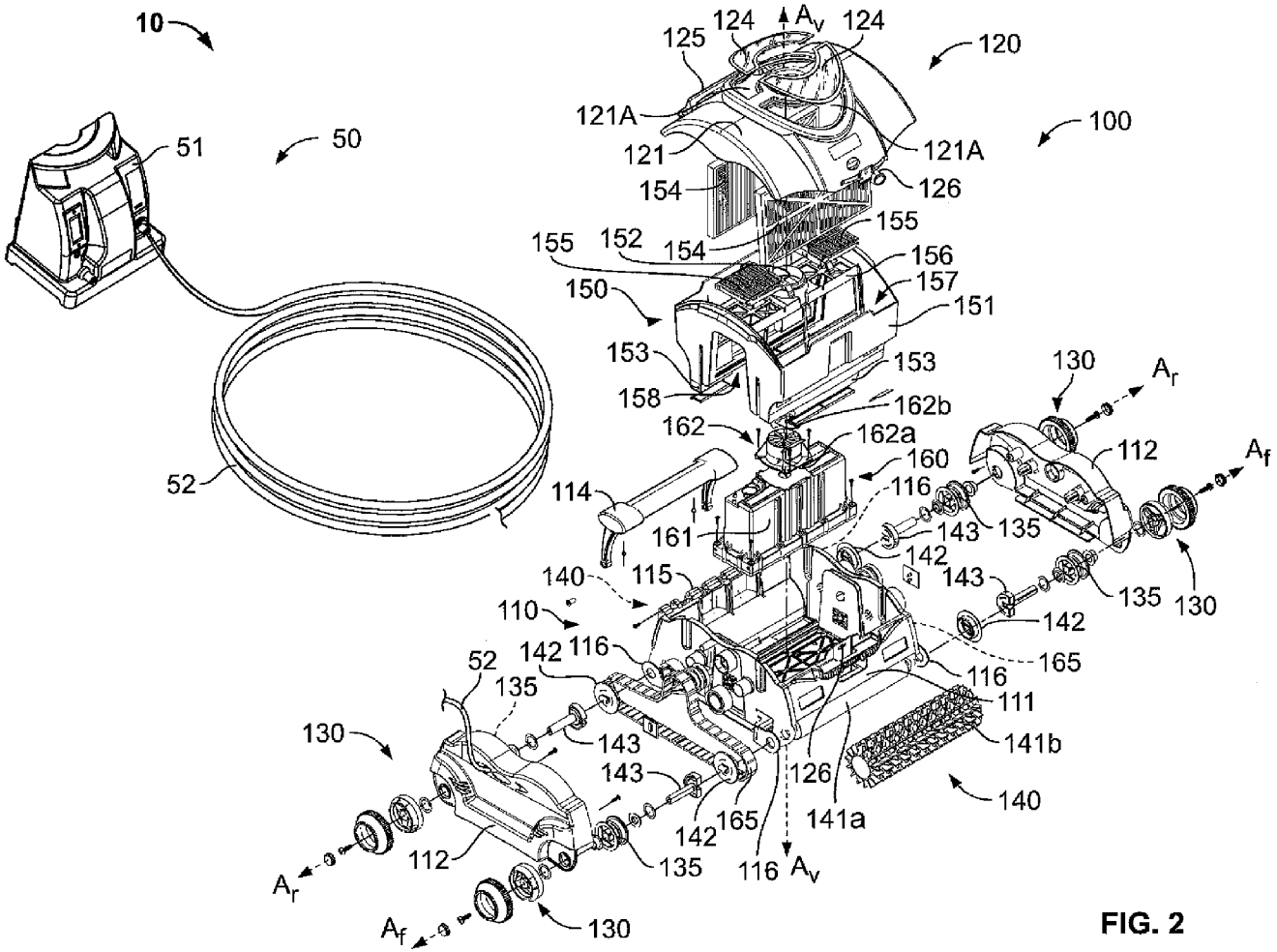
FIG. 2 depicts an exploded perspective view of the cleaner assembly of FIG. 1.
Figure 3:
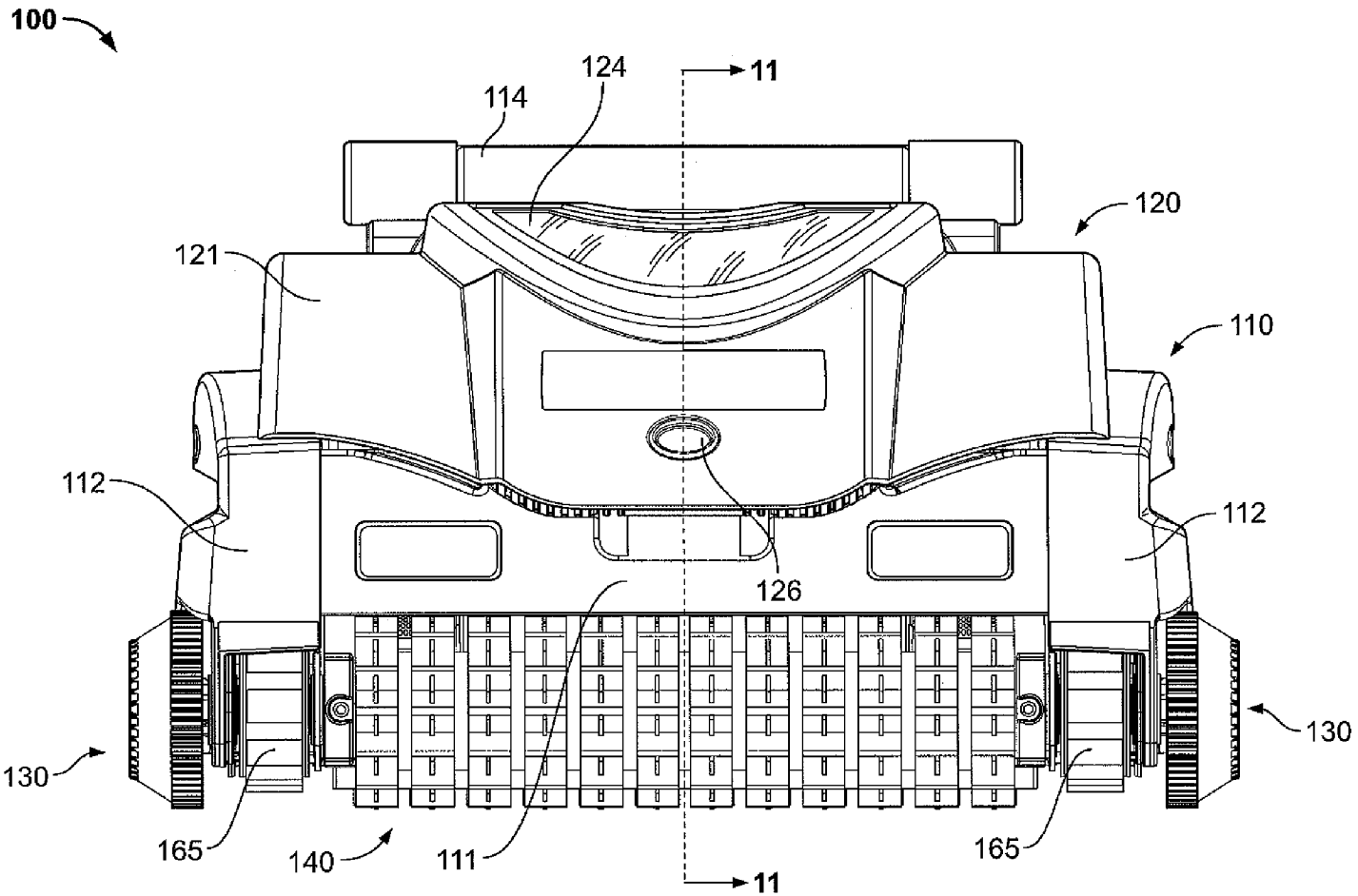
FIG. 3 depicts a front elevational view of the cleaner of FIGS. 1-2.
Figure 4:
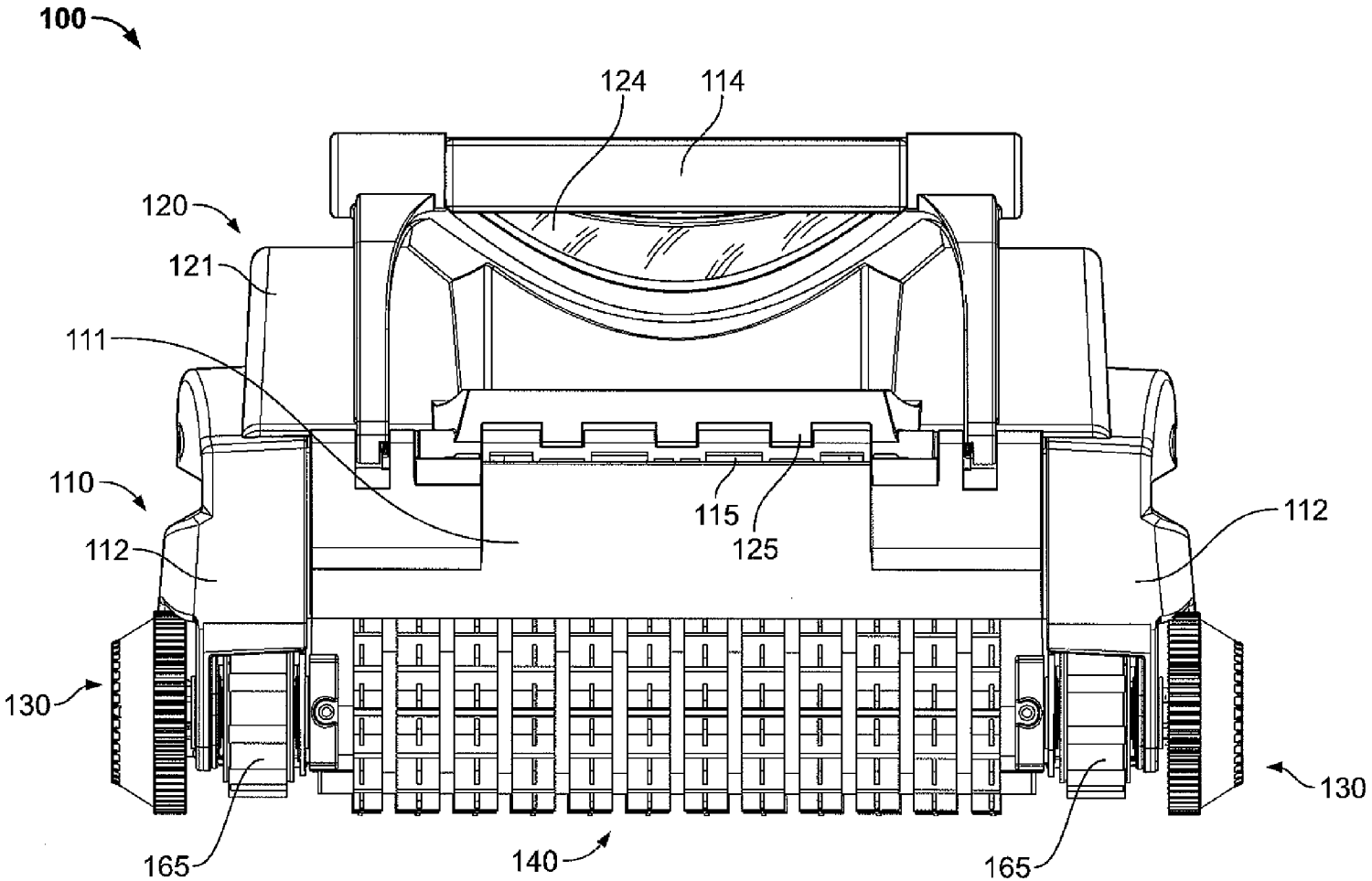
FIG. 4 depicts a rear elevational view of the cleaner of FIGS. 1-3.
Figure 5:
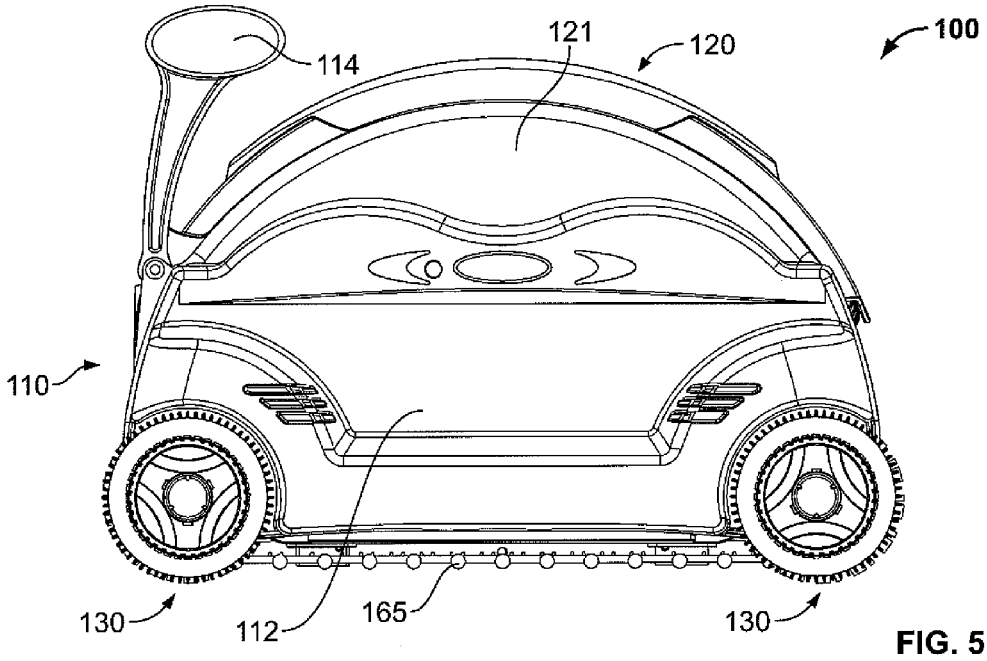
FIG. 5 depicts a left side elevational view of the cleaner of FIGS. 1-4.
Figure 6:
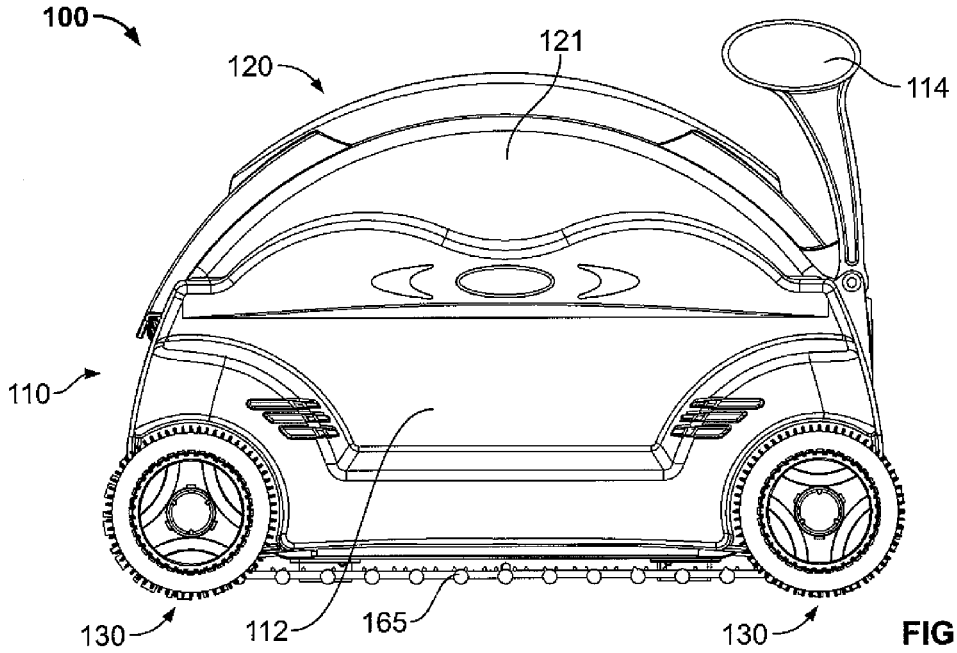
FIG. 6 depicts a right side elevational view of the cleaner of FIGS. 1-5.
Figure 7:
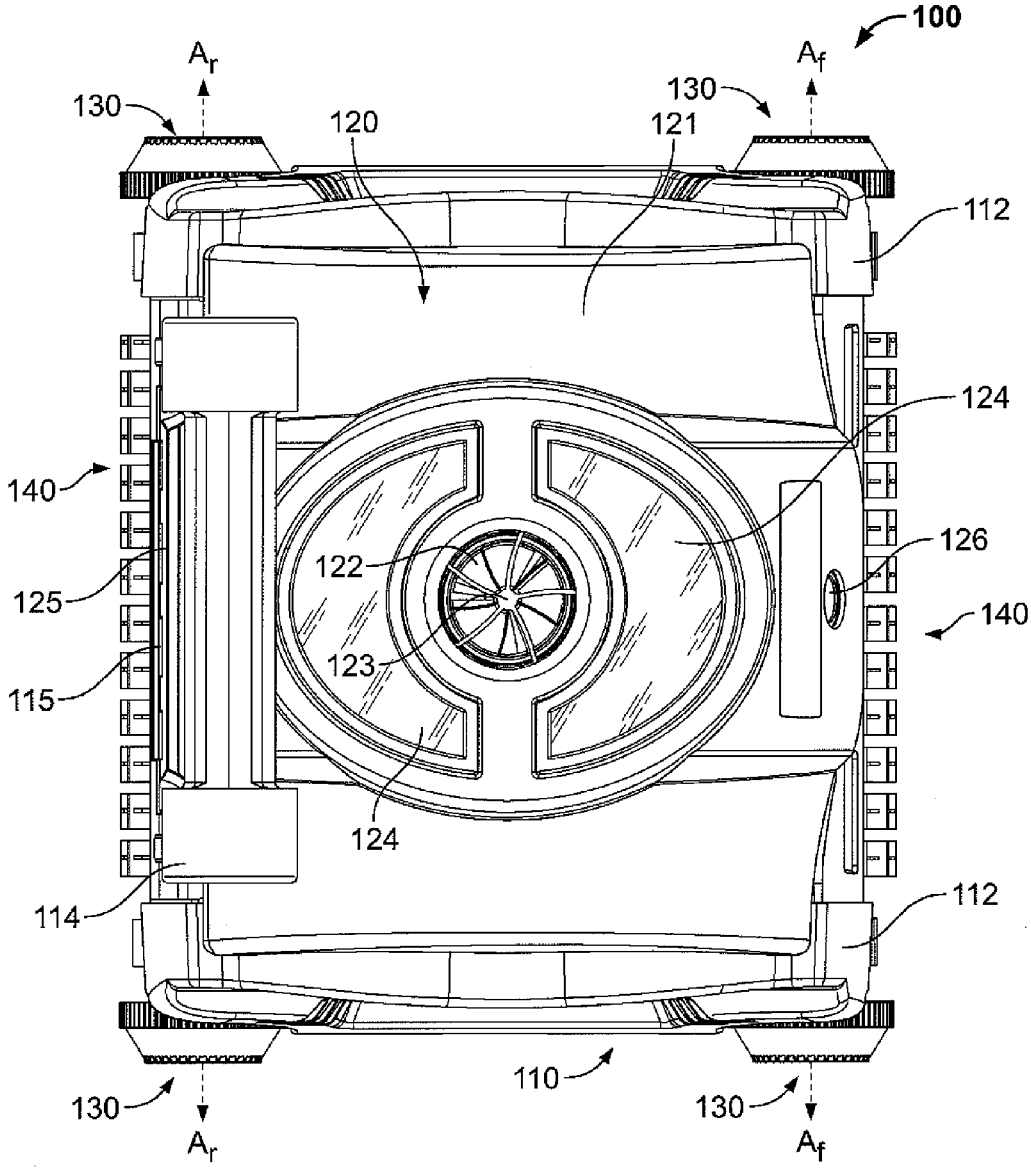
FIG. 7 depicts a top plan view of the cleaner of FIGS. 1-6.
Figure 8:
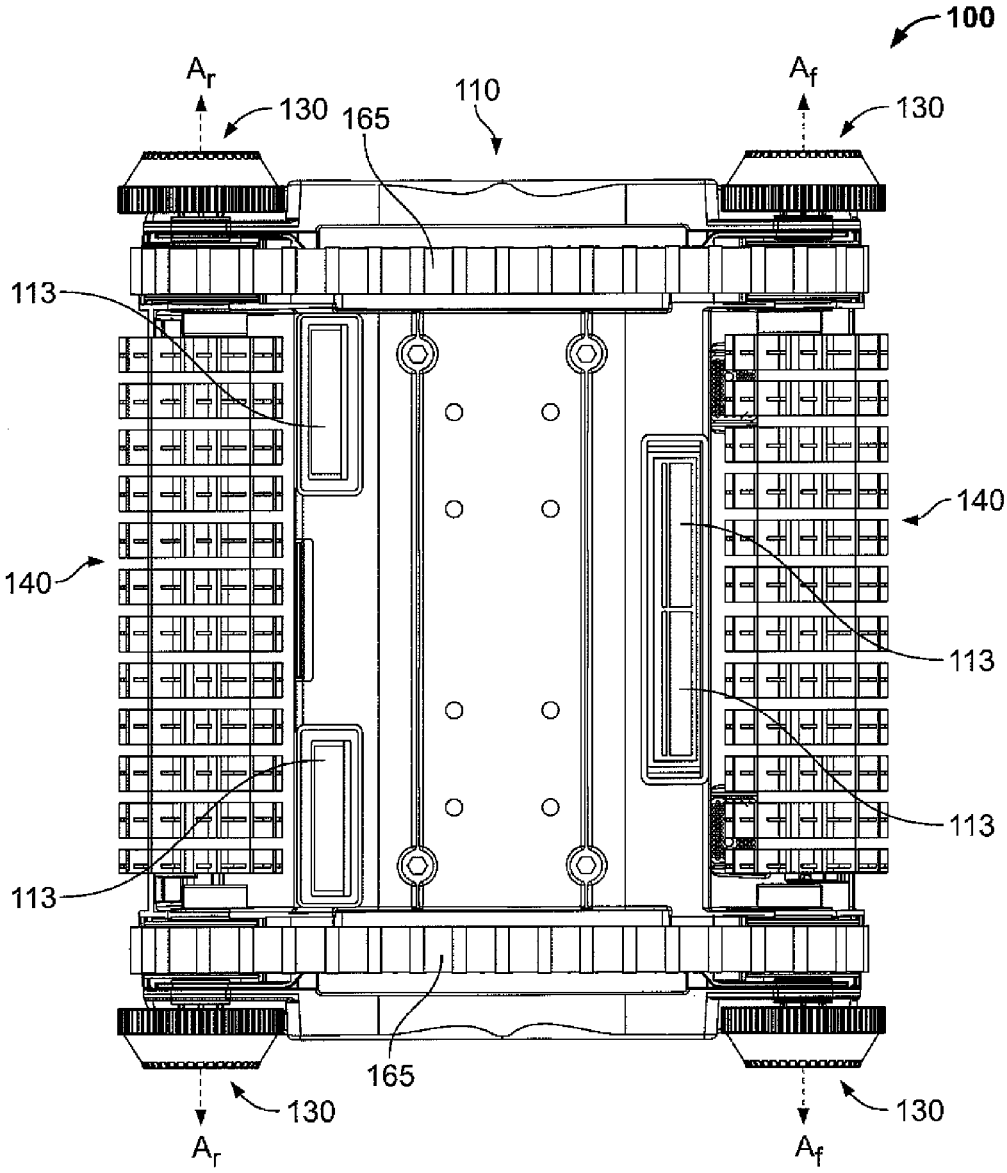
FIG. 8 depicts a bottom plan view of the cleaner of FIGS. 1-7.
Figure 18A:
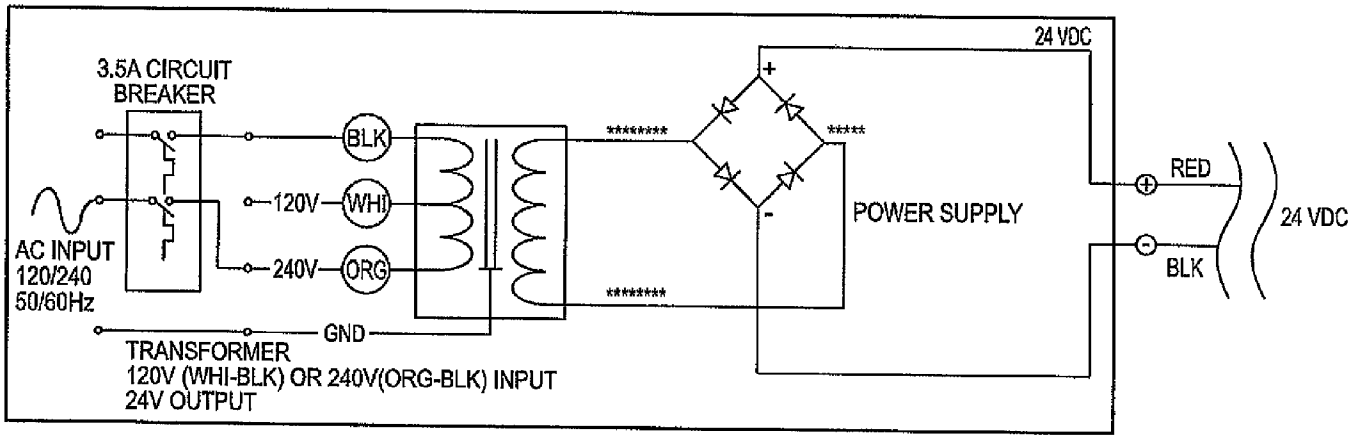
FIGS. 18A and 18B depicts electrical schematics for the cleaner assembly of FIGS. 1 and 2.
Figure 18B:
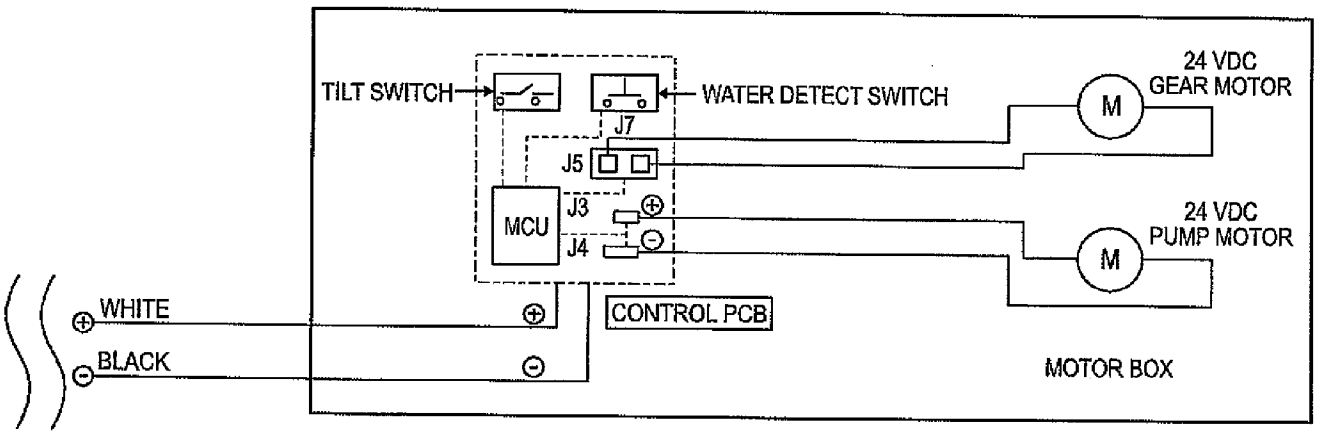

With initial reference to FIGS. 1-2, a cleaner assembly 10 generally includes a cleaner 100 and a power source such as an external power supply 50. Power supply 50 generally includes a transformer/control box 51 and a power cable 52 in communication with the transformer/control box 51 and the cleaner. In an exemplary embodiment, the pool cleaner 10 is an electrical pool cleaner, and sample electrical schematics for the cleaner assembly 10 generally are depicted in FIGS. 18A and 18B. Additional and/or alternative power sources are contemplated.

Referring to FIGS. 1-8 and 10, the cleaner 100 generally includes a housing assembly 110, a lid assembly 120, a plurality of wheel assemblies 130, a plurality of roller assemblies 140, a filter assembly 150 and a motor drive assembly 160, which shall each be discussed further below.

The housing assembly 110 and lid assembly 120 cooperate to define internal cavity space for housing internal components of the cleaner 100. In exemplary embodiments, the housing assembly 110 may define a plurality of internal cavity spaces for housing components of the cleaner 100. The housing assembly 110 includes a central cavity defined by base 111 and side cavities defined by side panels 112. The central cavity may house and receive the filter assembly 150 and the motor drive assembly 160. The side cavities may be used to house drive transfer system components, such as the drive belts 165, for example.

The drive transfer system is typically used to transfer power from the motor drive assembly 160 to the wheel assemblies 130 and the roller assemblies 140. For example, one or more drive shafts 166 (see, in particular, FIG. 10) may extend from the motor drive assembly 160, each drive shaft 166 extending through a side wall of the base 111, and into a side cavity. Therein the one or more drive shafts 166 may interact with the drive transfer system, e.g., by turning the drive belts 165. The drive belts 165 generally extend around and act to turn the bushing assemblies 135. Each mount 143 of the quick release mechanism includes an irregularly shaped axel 143B extending through complementary-shaped apertures within an associated one of the bushing assemblies 135 and an associated one of the wheel assemblies, such that rotation of the bushing assemblies 135 thereby rotates the irregularly shaped axel 143B, hence driving both the associated roller assembly 140 and the associated wheel assembly 130.

Regarding the position of the bushing assemblies 135, etc., the housing assembly 110 may include a plurality of brackets 116 each extending out from a side wall of the base 111 and having a flange parallel to said side wall, wherein a bushing assembly 135 can be positioned between the flange and side wall. The side walls and brackets 116 typically define a plurality of holes to co-axially align with an aperture defined through each bushing assembly 135. In exemplary embodiments, the axel 143B (discussed in greater detail with reference to FIG. 9B), may be inserted through each bracket 116, bushing assembly 135 and the corresponding side wall, defining an axis of rotation for the corresponding wheel assembly 130 and a roller assembly 140 associated with said axel.

The housing assembly 110 typically includes a plurality of filtration intake apertures 113 (see, in particular, FIGS. 8 and 10) located, for example, on the bottom and/or side of the housing assembly 110. The intake apertures 113 are generally configured and dimensioned to correspond with openings, e.g., intake channels 153, in the filter assembly 150. The intake apertures 113 and intake channels 153 can be large enough to allow for the passage of debris such as leaves, twigs, etc. However, since the suction power of the filtration assembly 150 may depend in part on surface area of the intake apertures 113 and/or intake channels 153, it may be advantageous, in some embodiments, to minimize the size of the intake apertures 113 and/or intake channels 153, e.g., to increase the efficiency of the cleaner 100. The intake apertures 113 and/or intake channels 153 may be located such that the cleaner 100 cleans the widest area during operation. For example, the front intake apertures 113 for the cleaner 100 can be positioned towards the middle of the housing assembly 110, while the rear intake apertures 113 can be positioned towards the sides of the housing assembly 110. In exemplary embodiments, intake apertures 113 may be included proximal the roller assemblies 140 to facilitate the collection of debris and particles from the roller assemblies 140 (see, in particular, FIG. 10). The intake apertures 113 can advantageously serve as drains for when the cleaner 100 is removed from the water.

In exemplary embodiments, the housing assembly 110 may include a cleaner handle 114, e.g., for facilitating extraction of the cleaner 100 from a pool.

In order to facilitate easy access to the internal components of the cleaner 100, the lid assembly 120 includes a lid 121 which is pivotally associated with the housing assembly 110. For example, the housing assembly 110 and lid assembly 120 may include hinge components 115, 125, respectively, for hingedly connecting the lid 121 relative to the housing assembly 110. Note, however, that other joining mechanisms, e.g., pivot mechanism, a sliding mechanism, etc., may be used, provided that the joining mechanism effect a removable relationship between the lid 121 and housing assembly 110. In this regard, a user may advantageously change the lid assembly 120 back and forth between an open position and a closed position, and it is contemplated that the lid assembly 120 can be provided so as to be removably securable to the housing assembly 110.

The lid assembly 120 may advantageously cooperate with the housing assembly 110 to provide for top access to the internal components of the cleaner 100. The filter assembly 150 may be removed quickly and easily for cleaning and maintenance without having to "flip" the cleaner 100 over. In some embodiments, the housing assembly 110 has a first side in secured relationship with the wheel assemblies 130 and a second side opposite such first side and in secured relationship with the lid assembly 120. The lid assembly 120 and the housing assembly 110 may include a latch mechanism, e.g., a locking mechanism 126, to secure the lid 121 in place relative to the housing assembly 110.

The lid 121 is typically configured and dimensioned to cover an open top-face of the housing assembly 110. The lid 121 defines a vent aperture 122 that cooperates with other openings (discussed below) to form a filtration vent shaft. For example, the vent aperture 122 is generally configured and dimensioned to correspond with an upper portion of a vent channel 152 of the filter assembly 150. The structure and operation of the filtration vent shaft and the vent channel 152 of the filter assembly are discussed in greater detail herein. Note that the vent aperture 122 generally includes guard elements 123 to prevent the introduction of objects, e.g., a user's hands, into the vent shaft. The lid assembly 120 can advantageously includes one or more transparent elements, e.g., windows 124 associated with the lid 121, which allow a user to see the state of the filter assembly 150 while the lid assembly 120 is in the closed position. In some embodiments, it is contemplated that the entire lid 121 may be constructed from a transparent material. Exemplary embodiments of the lid assembly 120 and the lid 121 are discussed in greater detail below with reference to FIGS. 16-17.

The cleaner 100 is typically supported/propelled about a pool by the wheel assemblies 130 located relative to the bottom of the cleaner 100. The wheel assemblies 130 are usually powered by the motor drive assembly 160 in conjunction with the drive transfer system, as discussed herein. In exemplary embodiments, the cleaner 100 includes a front pair of wheel assemblies 130 aligned along a front axis $A_f$ and a rear pair of wheel assemblies 130 aligned along a rear axis $A_r$. Each wheel assembly 130 may include a bushing assembly 135 aligned along the proper corresponding axis $A_f$ or $A_r$, and axially connected to a corresponding wheel, e.g., by means of and in secured relationship with the axel 143B. As discussed herein, the drive belts 165 turn the bushing assemblies 135 which turn the wheels.

The cleaner 100 can include roller assemblies 140 to scrub the walls of the pool during operation. In this regard, the roller assemblies 140 may include front and rear roller assemblies 140 integrally associated with said front and rear sets of wheel assemblies, respectively (e.g., wherein the front roller assembly 140 and front set of wheel assemblies 130 rotate in cooperation around axis $A_f$ and/or share a common axel e.g., the axel 143B).

While the four-wheel, two-roller configuration discussed herein advantageously promotes device stability/drive efficiency, the current disclosure is not limited to such configuration. Indeed, three-wheel configurations (such as for a tricycle), two-tread configurations (such as for a tank), tri-axial configurations, etc., may be appropriate, e.g. to achieve a better turn radius, or increase traction. Similarly, in exemplary embodiments, the roller assemblies 140 may be independent from the wheel assemblies 130, e.g., with an autonomous axis of rotation and/or independent drive. Thus, the brush speed and/or brush direction may advantageously be adjusted, e.g., to optimize scrubbing.

The roller assemblies 140 advantageously include a quick release mechanism which allows a user to quickly and easily remove a roller 141 for cleaning or replacement. In exemplary embodiments (see FIG. 2), an inner core 141A and an outer disposable/replaceable brush 141B may cooperate to form the roller (not designated in FIG. 2). Note, however, that various other rollers 141 may be employed without departing from the spirit or scope of the present disclosure, e.g., a cylindrical sponge, a reusable brush without an inner core element, etc. The roller assemblies 140 and the quick release mechanism are discussed in greater detail with reference to FIGS. 9A and 9B. It is contemplated that the roller 141 can be integrally formed, such that the core and brush are monolithic, for example.

Figure 9A:
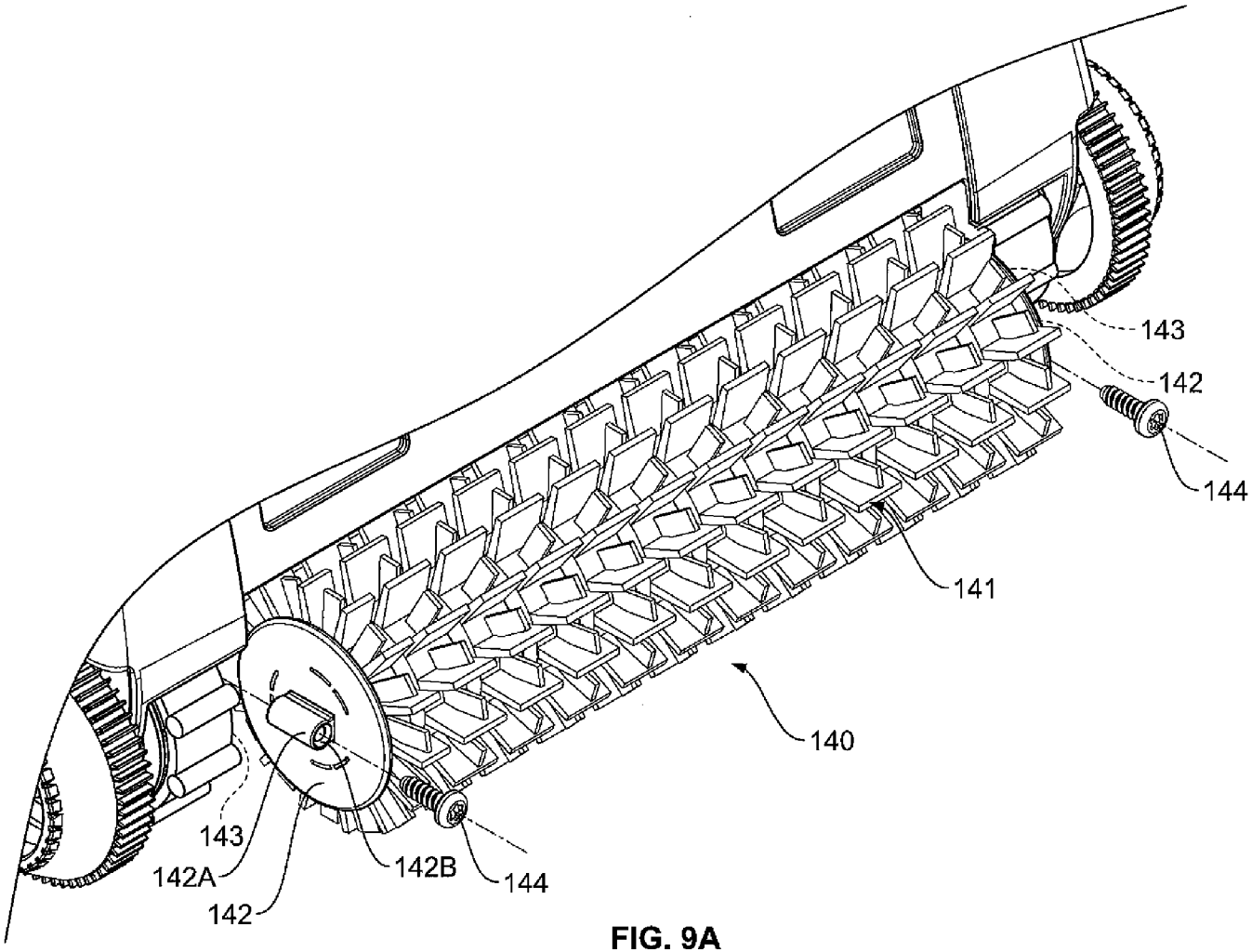
FIGS. 9A and 9B depict a quick-release mechanism associated with the roller assemblies of FIGS. 1-8.
Figure 9B:
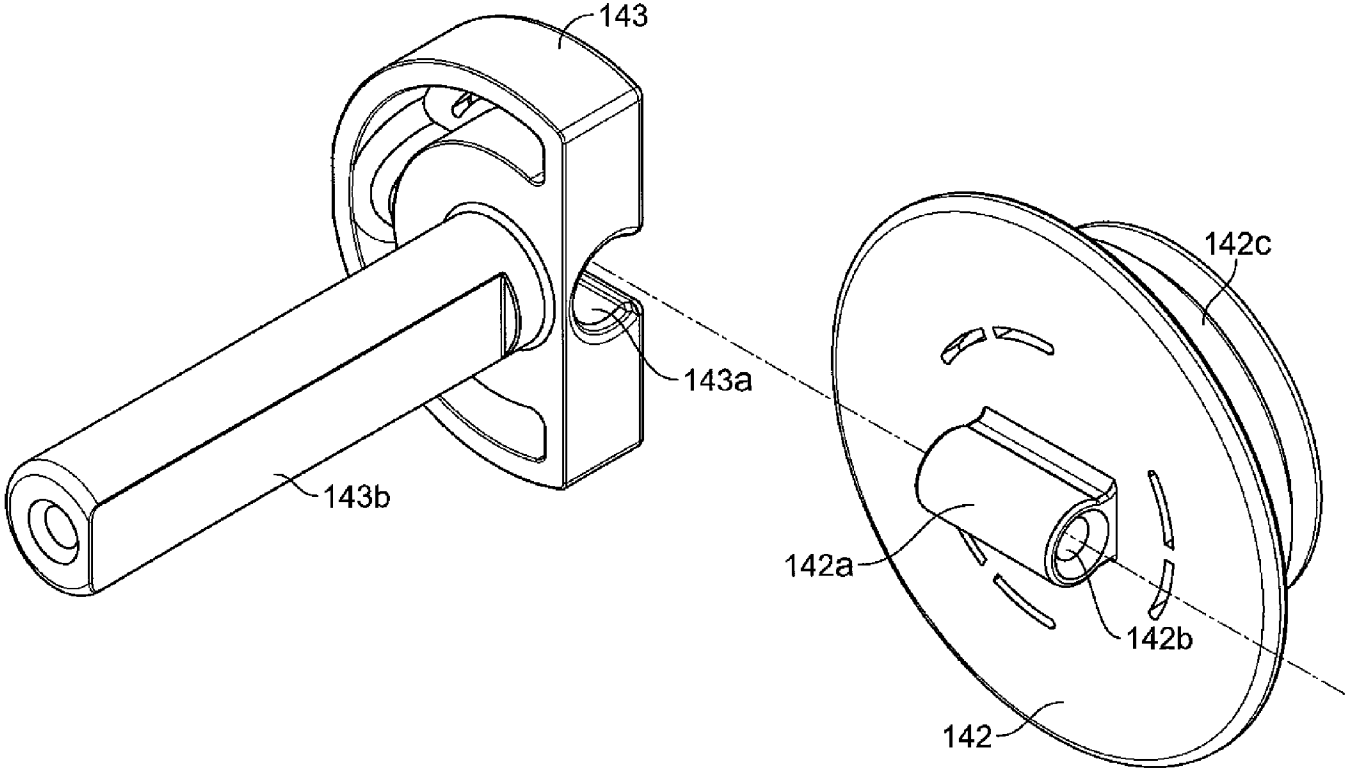
Figure 10:
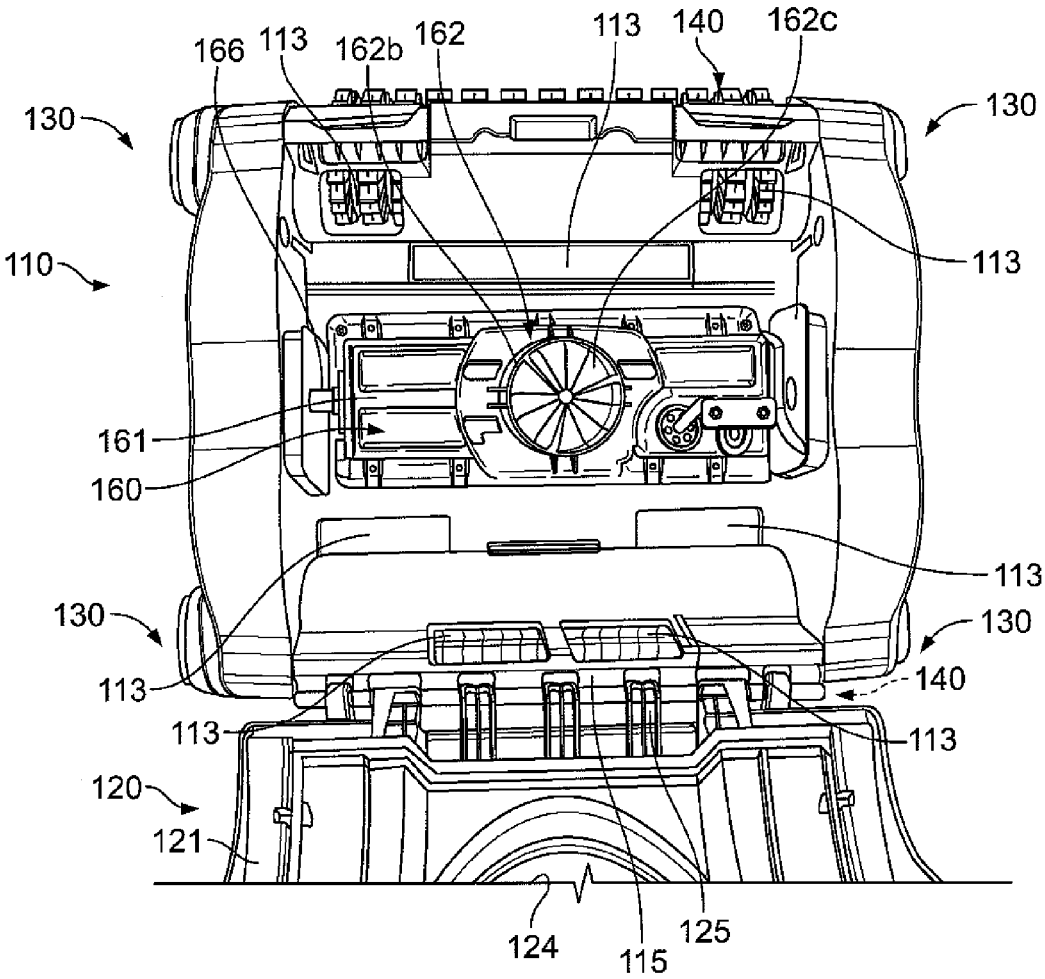
FIG. 10 depicts a top plan view of the cleaner of FIGS. 1-8, wherein the lid assembly is shown in an open position and the filter assembly has been removed.

With reference now to FIG. 9A, an enlarged exploded view of the front roller assembly 140 of the cleaner 100 is depicted. The front roller assembly 140 is advantageously provided with a quick release mechanism for removing/replacing a roller. Referring now to FIG. 9B, an exemplary quick release mechanism for a roller assembly, e.g., the front roller assembly 140 of FIG. 9A, is depicted using a tongue and groove. Referring now to FIGS. 9A and 9B, the front roller assembly 140 typically includes a roller 141, end joints 142 and mounts 143. In exemplary embodiments, the end joints 142 include annular lipped protrusions 142C to secure the end joints relative to the ends of the roller 141. In exemplary embodiments, the annular lipped protrusions 142C are dimensioned and configured to be received by the core 141A of the roller 141. Generally, the end joints 142 may cooperate with the mounts 143 to removably connect the roller 141 relative to the cleaner during operation. Each mount 143, therefore generally includes an axel 143B which may include a flat surface, extend along the front axis $A_f$ through an eyelet in the corresponding side wall of the base 111, through the corresponding bushing assembly 135, through an eyelet in the corresponding bracket 116, and secure the corresponding wheel assembly 130. The axel 143B may advantageously include a flat edge and the roller bushing assembly 135 and wheel assembly 130 have a correspondingly shaped and dimensioned aperture receiving the axel 143B, such that drive of the bushing assembly 135 drives the mount 143 and the roller assembly 140 generally (and the wheel assembly 130).

The roller assembly 140 disclosed herein advantageously employs a facially accessible, quick release mechanism wherein the roller 141 may quickly be removed from the mounts 143 for cleaning or replacement purposes. Thus, in exemplary embodiments, each roller end 142 may include a tongue element 142A configured and dimensioned to correspond with a groove element 143A defined in the corresponding mount 143. A fastener 144, e.g., a pin, screw, rod, bolt etc., may be inserted through a slot 142B defined radially in the tongue element 142B and into the mount to secure the roller in place. In this regard, the roller 141 can be positioned within a geometric space bound at locations proximal the ends of the roller 141, while still allowing for quick-release. In some embodiments, such as those shown, for example, a longitudinal side of the roller 141 remains unobstructed and the fastener-receiving passage is orientated radially, thereby allowing easy removal of the fastener through the unobstructed area. The tongue and groove configuration advantageously allows a user to remove/load a roller 141 from a radially oriented direction. Though the tongue and groove configuration is shown, it is contemplated that other suitable configurations can be employed, e.g., a spring release, latch, etc.

Figure 11:
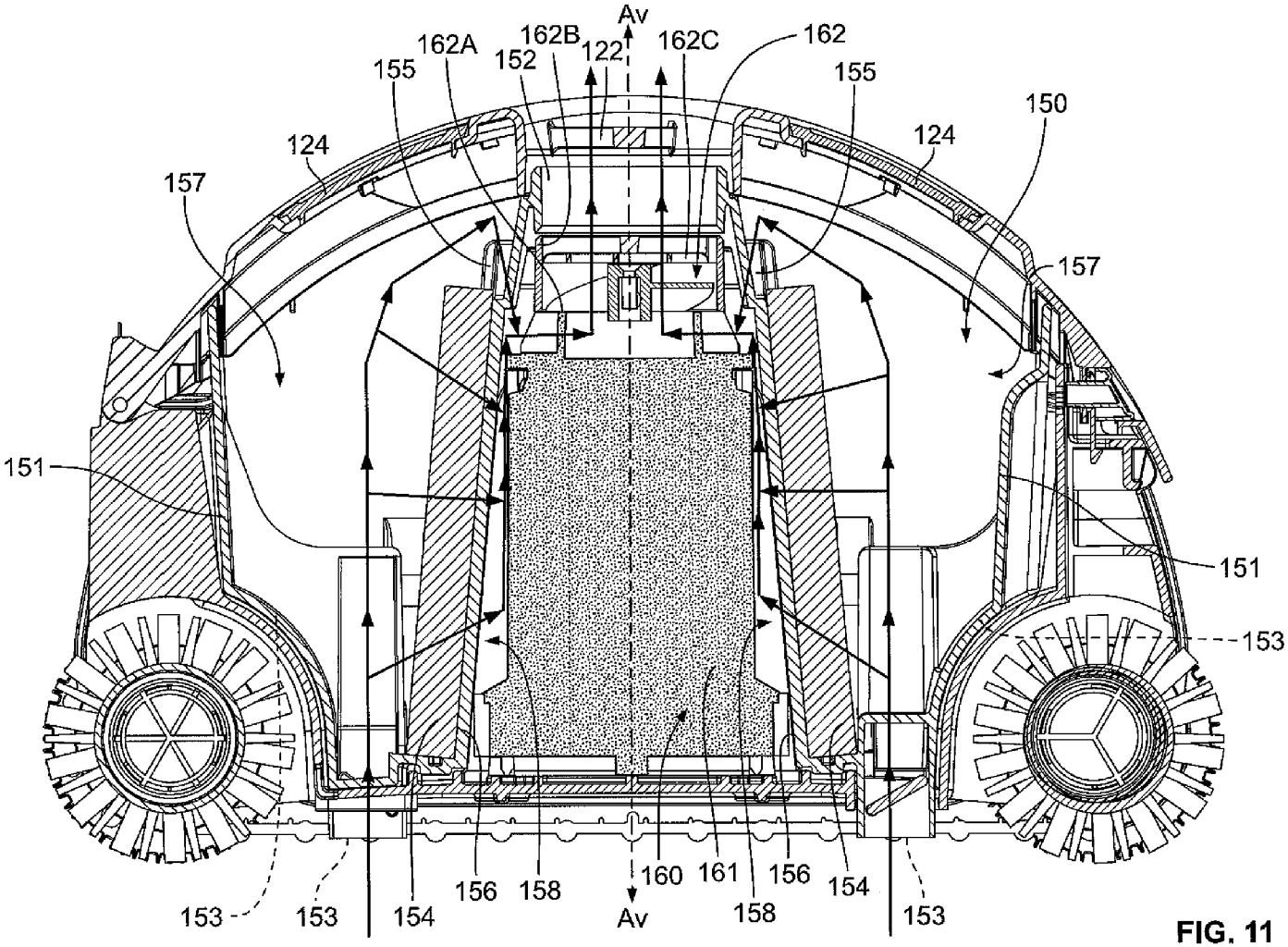
FIG. 11 depicts a partial cross-section of the cleaner of FIGS. 1-8 along section line 11-11 of FIG. 3 with the handle having been removed, with portions of the motor drive assembly being represented generally without section, and with directional arrows added to facilitate discussion of an exemplary fluid flow through the pool cleaner.

Referring now to FIGS. 2 and 11, the filter assembly 150 is depicted in cross-section and the motor drive assembly 160 is depicted generally. The motor drive assembly 160 generally includes a motor box 161 and an impeller unit 162. The impeller unit 162 is typically secured relative to the top of the motor box 161, e.g., by screws, bolts, etc. In exemplary embodiments, the motor box 161 houses electrical and mechanical components which control the operation of the cleaner 100, e.g., drive the wheel assemblies 130, the roller assemblies 140, and the impeller unit 162.

In exemplary embodiments, the impeller unit 162 includes an impeller 162C, an apertured support 162A (which defines intake openings below the impeller 162C), and a duct 162B (which houses the impeller 162C and forms a lower portion of the filtration vent shaft). The duct 162B is generally configured and dimensioned to correspond with a lower portion of the vent channel 152 of the filter assembly 150. The duct 162B, vent channel 152, and vent aperture 122 may cooperate to define the filtration vent shaft which, in some embodiments, extends up along the ventilation axis $A_v$ and out through the lid 121. The impeller unit 162 acts as a pump for the cleaner 100, drawing water through the filter assembly 150 and pushing filtered water out through the filtration vent shaft. An exemplary filtration flow path for the cleaner 100 is designated by directional arrows depicted in FIG. 11.

The motor drive assembly 160 is typically secured, e.g., by screws, bolts, etc., relative to the inner bottom surface of the housing assembly 110. The motor drive assembly 160 is configured and dimensioned so as to not obstruct the filtration intake apertures 113 of the housing assembly 110. Furthermore, the motor drive assembly 160 is configured and dimensioned such that cavity space remains in the housing assembly 110 for the filter assembly 150.

The filter assembly 150 includes one or more filter elements (e.g., side filter panels 154 and top filter panels 155), a body 151 (e.g., walls, floor, etc.), and a frame 156 configured and dimensioned for supporting the one or more filter elements relative thereto. The body 151 and the frame 156 and/or filter elements generally cooperate to define a plurality of flow regions including at least one intake flow region 157 and at least one vent flow region 158. More particularly, each intake flow region 157 shares at least one common defining side with at least one vent flow region 158, wherein the common defining side is at least partially defined by the frame 156 and/or filter element(s) supported thereby. The filter elements, when positioned relative to the frame 156, form a semi-permeable barrier between each intake flow region 157 and at least one vent flow region 158.

In exemplary embodiments, the body 151 defines at least one intake channel 153 in communication with each intake flow region 157, and the frame 156 defines at least one vent channel 152 in communication with each vent flow region 158. Each intake flow region 157 defined by the body 151 can be bucket-shaped to facilitate trapping debris therein. For example, the body 151 and frame 156 may cooperate to define a plurality of surrounding walls and a floor for each intake flow region 157. Exemplary embodiments of the structure and configuration of the filter assembly 150 are discussed in greater detail with reference to FIGS. 12-15.

Figure 12:
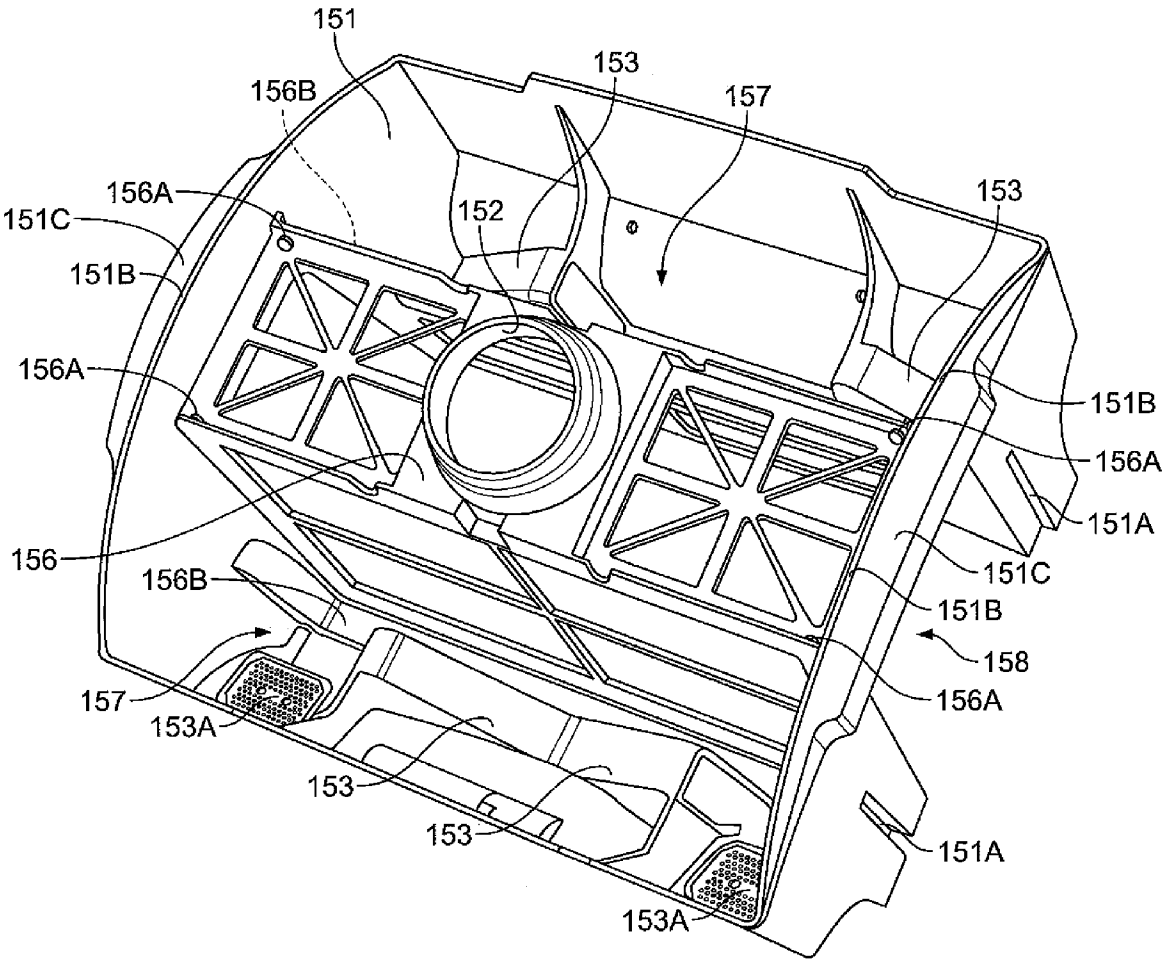
FIG. 12 depicts a top perspective view of a body and a frame included in the filter assembly of FIGS. 1-8, the body being shown integrally formed with the frame.
Figure 13:
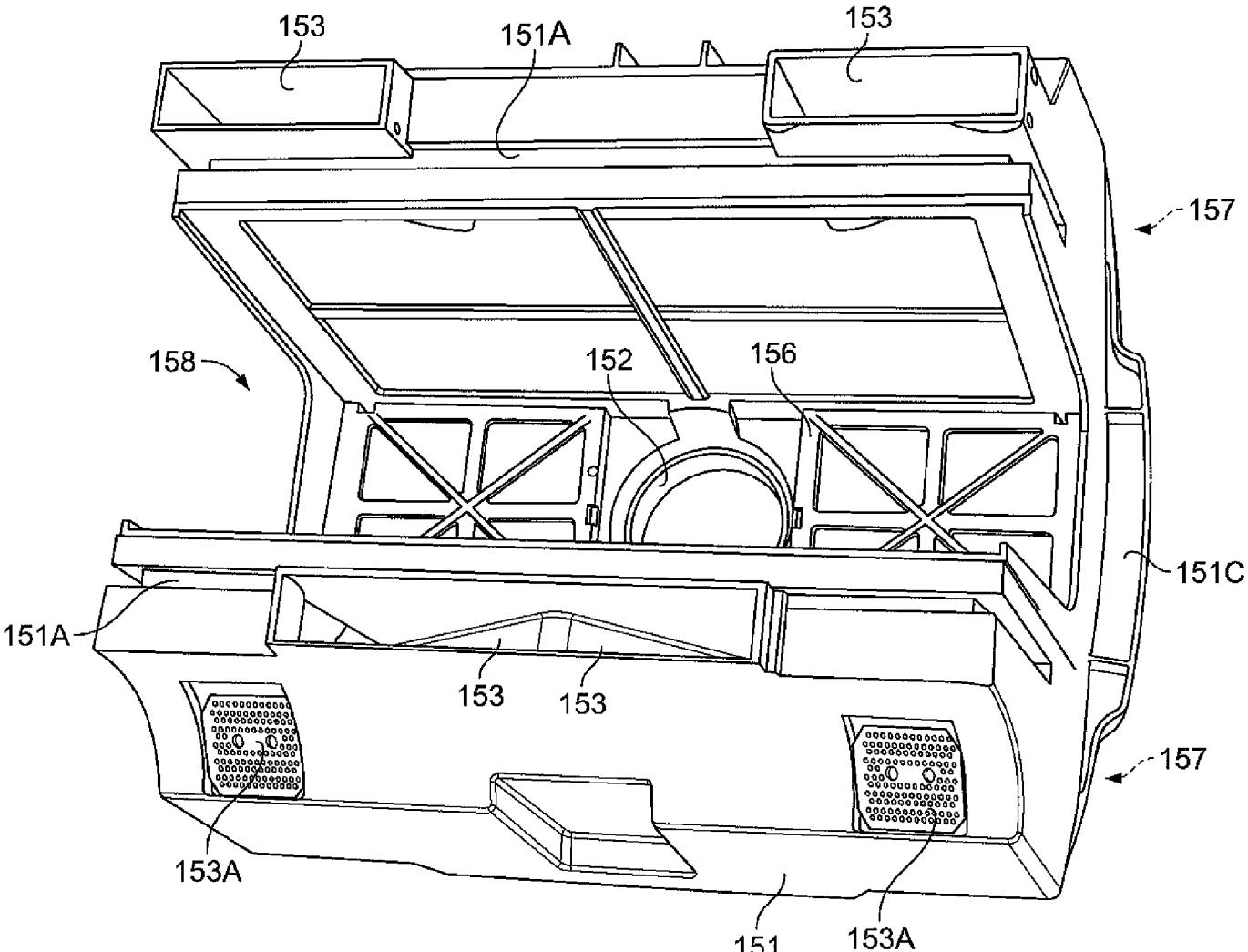
FIG. 13 depicts a bottom perspective view of the body and the frame integrally formed therewith of FIG. 12.

With reference now to FIGS. 12-13, the body 151 of the filter assembly 150 is depicted with the frame 156 shown integrally formed therewith. The body 151 has a saddle-shaped elevation. The body 151 is configured, sized, and/or dimensioned to be received for seating in the base 111 and the frame 156 is configured, sized, and/or dimensioned to fit over the motor drive assembly 160. When the filter assembly 150 is positioned within the housing assembly 110, the motor drive assembly 160 in effect divides the original vent flow region 158 into a plurality of vent flow regions 158, with each of the vent flow regions 158 in fluid communication with the intake openings defined by the apertured support 162A of the impeller 162C (see FIG. 11). To facilitate proper positioning of the filter assembly 150 within the cleaner 100, the body 151 may define slots 151A for association with flanges (not depicted) on the interior of the housing assembly 110. Filter handles 151C can be included for facilitating removal and replacement of the filter assembly 150 within the housing assembly 10. Though the filter assembly 150 can be bucket-like and/or have a saddle-shaped elevation, it is contemplated that any suitable configuration can be employed.

The body 151 can define a plurality of openings, e.g., intake channels 153 for association with the intake flow regions 157 and the intake apertures 113 of the housing assembly 110. In exemplary embodiments, such as depicted in FIG. 12, the intake channels 153 define an obliquely extending structure with negative space at a lower elevation and positive space at a higher elevation in alignment therewith. A bent flow path of the intake channels 153 helps prevent debris trapped within the intake flow regions 157 from escaping, e.g., descending downward through the channels by virtue of gravity or other force. Note, however, that alternative embodiments are contemplated. Also, it is contemplated that intake channels might extend up along the outside of the filter body and traverse the body 151 through the sides. In exemplary embodiments, lattice structures, e.g., lattices 153A, are provided for drainage, e.g., when the cleaner 100 is removed from a pool.

Figure 14:
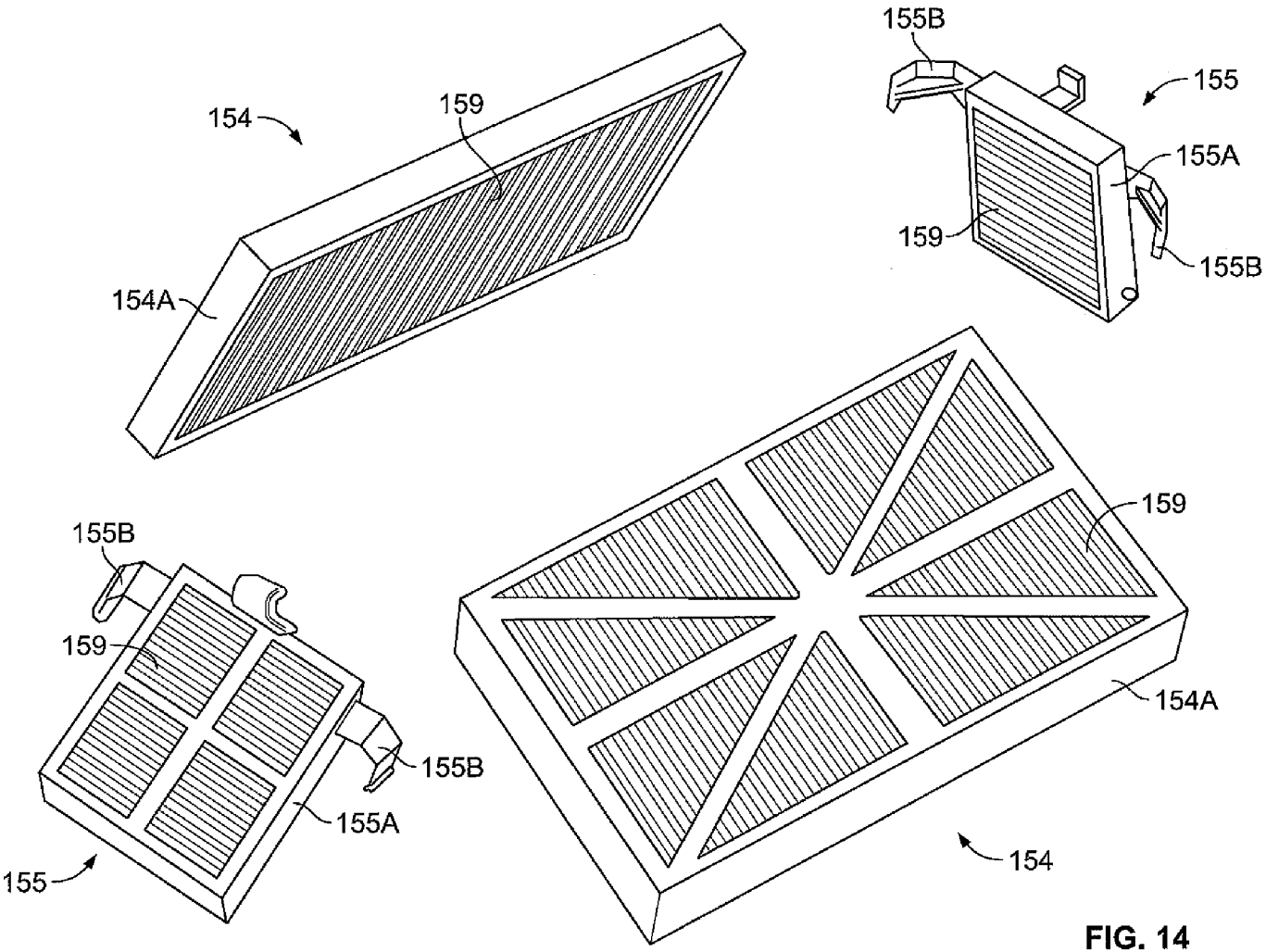
FIG. 14 depicts a top perspective view of a plurality of filter elements included in the filter assembly of FIGS. 1-8, the filter elements being shown to include top filter panels and side filter panels.
Figure 15:
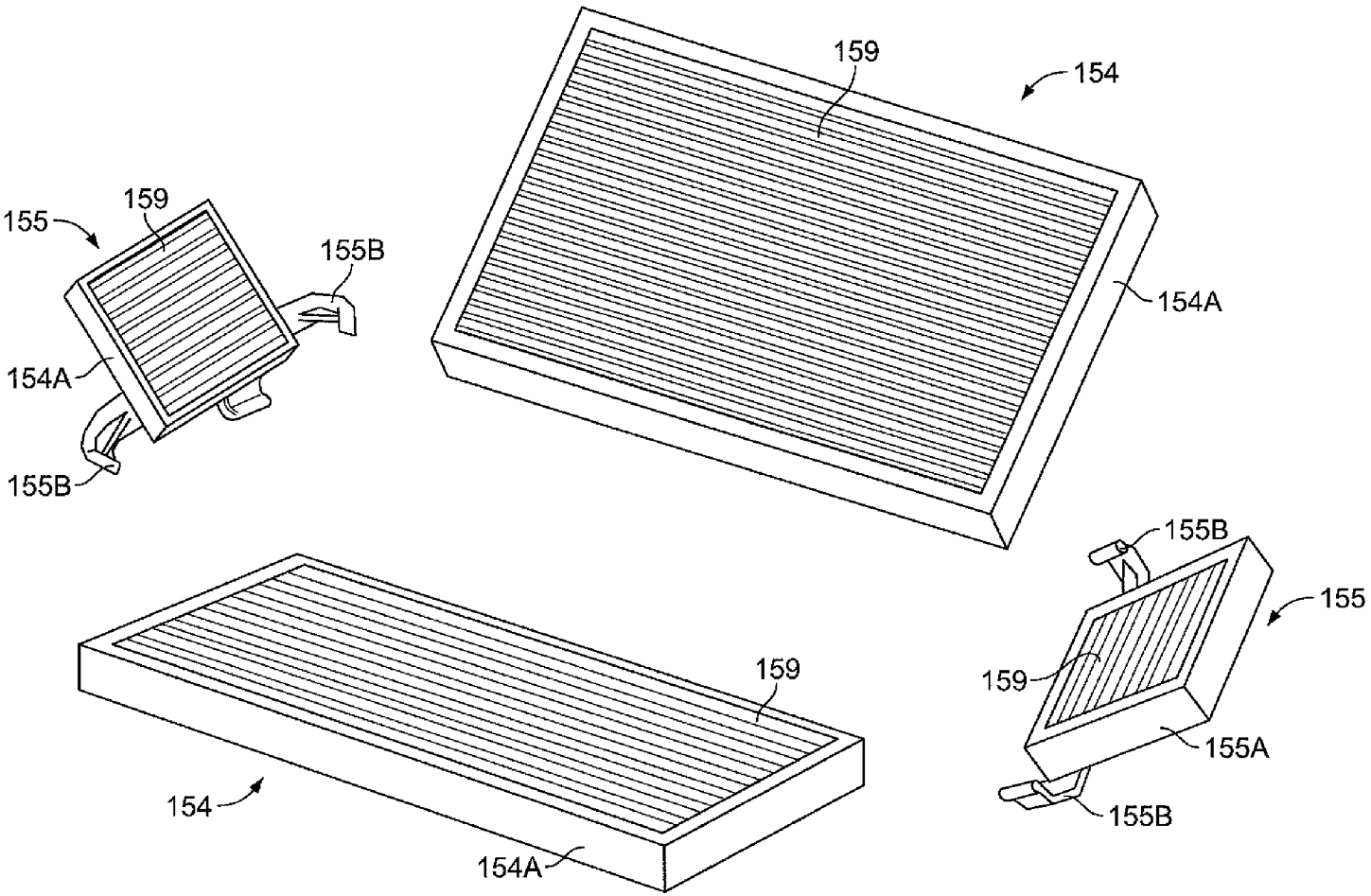
FIG. 15 depicts a bottom perspective view of the plurality of filter elements of FIG. 14.

As discussed, FIGS. 12-13 show a frame 156 designed to support filter elements, e.g., side and top filter panels relative thereto. Referring now to FIGS. 14-15, exemplary side filter panels 154 and top filter panels 155 are depicted. Each one of the filter panels 154, 155 includes a filter frame 154A or 155A and a filter material 159 supported thereby. The filter material 159 of the filter panels 154, 155 may be saw-toothed to increase the surface area thereof. Referring now to FIGS. 12-15, the frame 156 includes protrusions 156A for hingedly connecting the top filter panels 155 relative thereto. The side filter panels 154 fit into slots 156B in the body 151 and are supported by the sides of the frame 156. The top filter panels 155 may include finger elements 155B for securing the side filter panels 154 relative to the frame 156.

Note, however, that the exemplary frame/filter configuration presented herein is not limiting. Single-side, double side, top-only, etc., filter element configurations may be used. Indeed, filter elements and frames of suitable shapes, sizes, and configurations are contemplated. For example, while the semi-permeable barrier can be a porous material forming a saw tooth pattern, it is contemplated, for example, that the filter elements can include filter cartridges that include a semi-permeable material formed of a wire mesh having screen holes defined therethrough.

Figure 16:
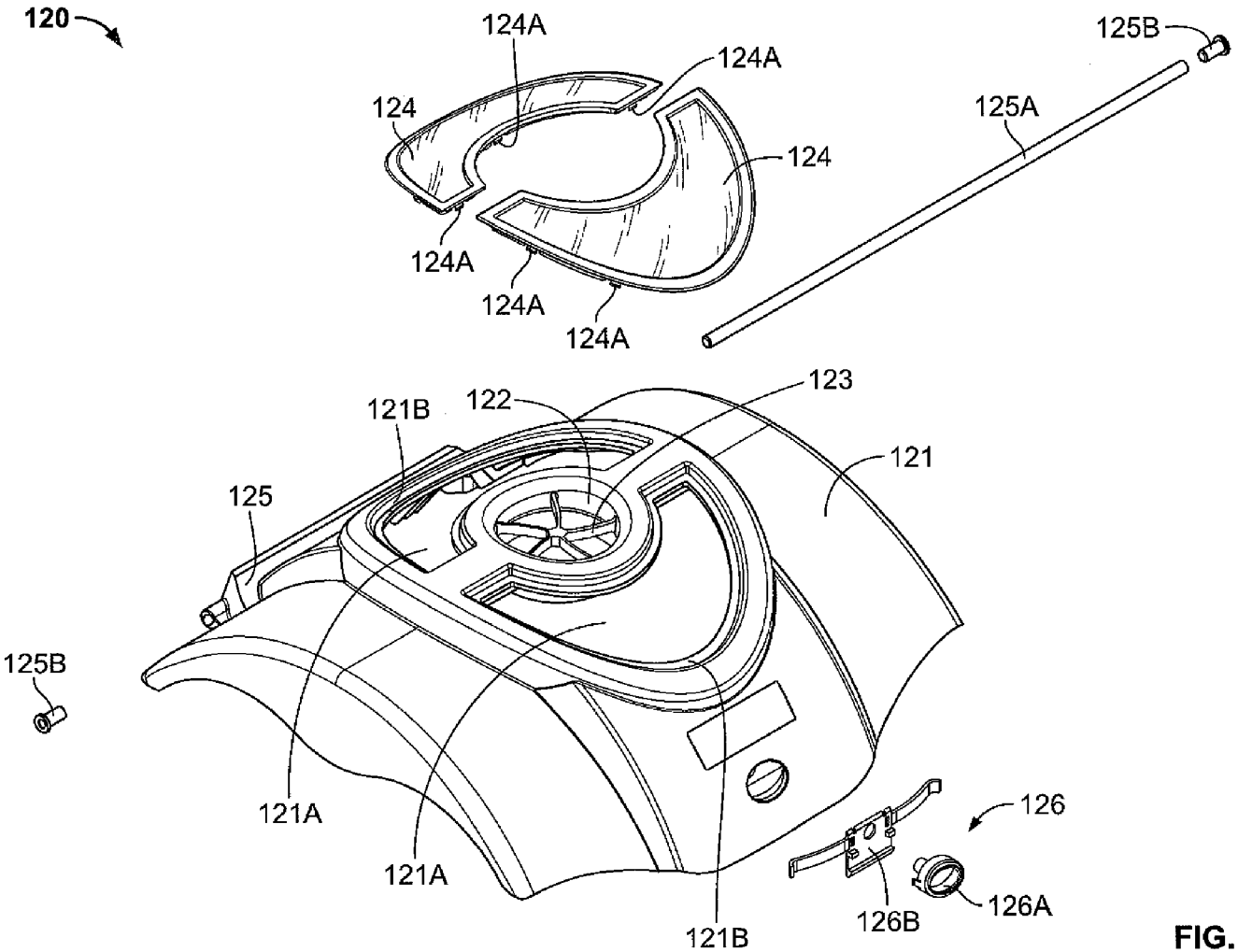
FIG. 16 depicts a top perspective view of the lid assembly of FIGS. 1-8. including a lid, windows, a latch mechanism, and a hinge component.
Figure 17:
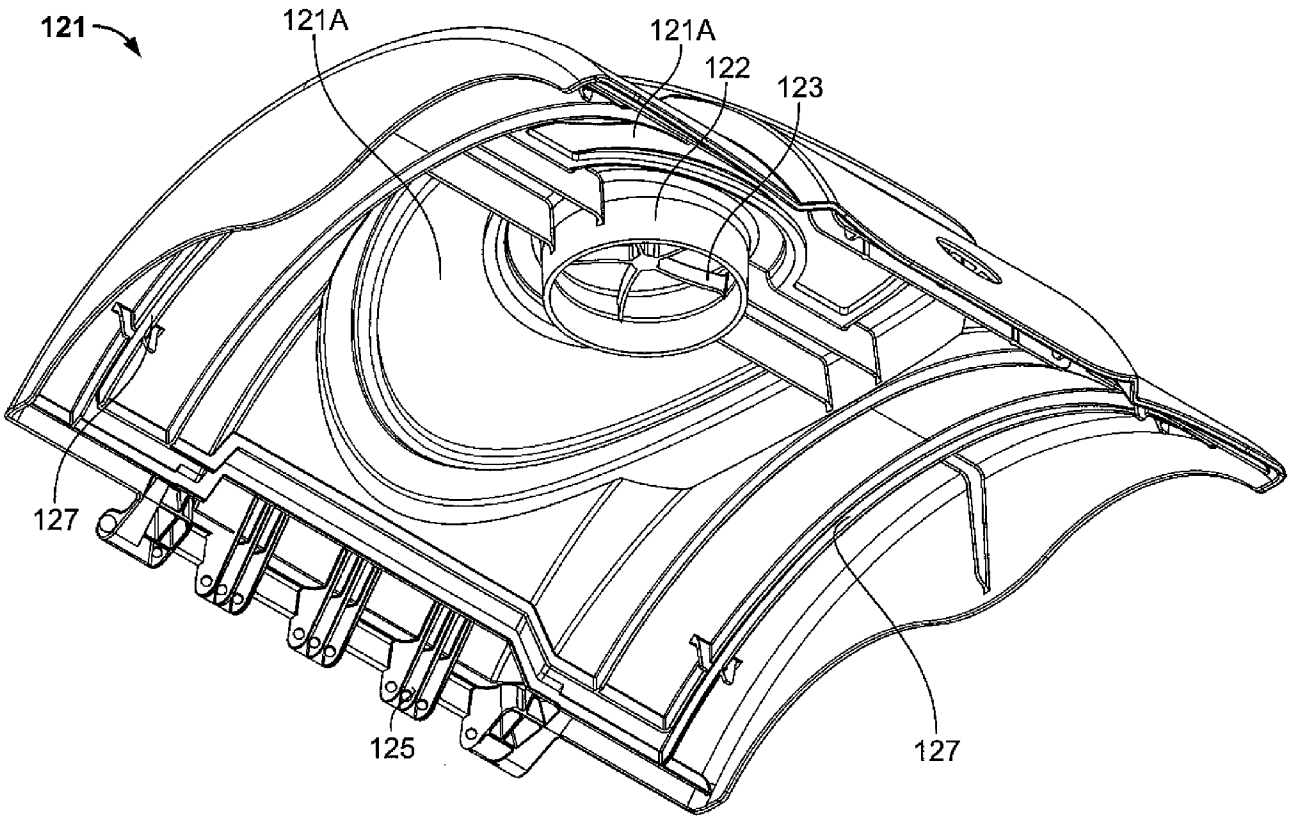
FIG. 17 depicts a bottom perspective view of the lid of FIG. 16 including grooves configured and dimensioned to mate with ridges on the filter assembly of FIGS. 1-8.

Referring to FIGS. 16 and 17, an exemplary lid assembly 120 for the cleaner 100 is depicted. Generally, the lid assembly 120 includes a lid 121 which is pivotally attached to the top of the housing assembly 110 by means of hinge components 115, 125 (note that the hinge component 115 of the housing assembly 110 is not depicted in FIG. 16). The hinge component 125 of the lid assembly 120 may be secured to the hinge component 115 of the housing assembly 110 using an axis rod 125A and end caps 125B. The lid assembly 20 advantageously provides top access to internal components of the cleaner 100. The lid 121 may be secured relative to the housing assembly 110 by means of a locking mechanism 126, e.g., a button 126A and spring 126B system. In some embodiments, it is contemplated that the lid assembly 120 is removable.

The lid 121 can include windows 124 formed of a transparent material. Thus, in exemplary embodiments, the lid 121 defines one or more window openings 121A, there-through. The window openings 121A may include a rimmed region 121B for supporting windows 124 relative thereto. Tabs 124A can be included to facilitate securing the windows 124 relative to the lid 121. The windows 124 may be advantageously configured and dimensioned to allow an unobstructed line of site to the intake flow regions 157 of the filter assembly 150 while the filter assembly 150 is positioned within the cleaner 100. Thus, a user is able to observe the state of the filter assembly 150, e.g., how much dirt/debris is trapped in the intake flow regions 157, and quickly ascertain whether maintenance is needed.

In exemplary embodiments, the lid 121 may define a vent aperture 122, the vent aperture 122 forming the upper portion of a filtration vent shaft for the cleaner 100. Guard elements 123 may be included to advantageously protect objects, e.g., hands, from entering the filtration vent shaft and reaching the impeller 162C. The lid 121 preferably defines grooves 127 relative to the bottom of the lid assembly 120. These grooves advantageously interact with ridges 151B defined around the top of the filter assembly 150 (see FIG. 12) to form a makeshift seal. By sealing the top of the filter assembly 150, suction power generated by the impeller 162C may be maximized.

Figure 19:
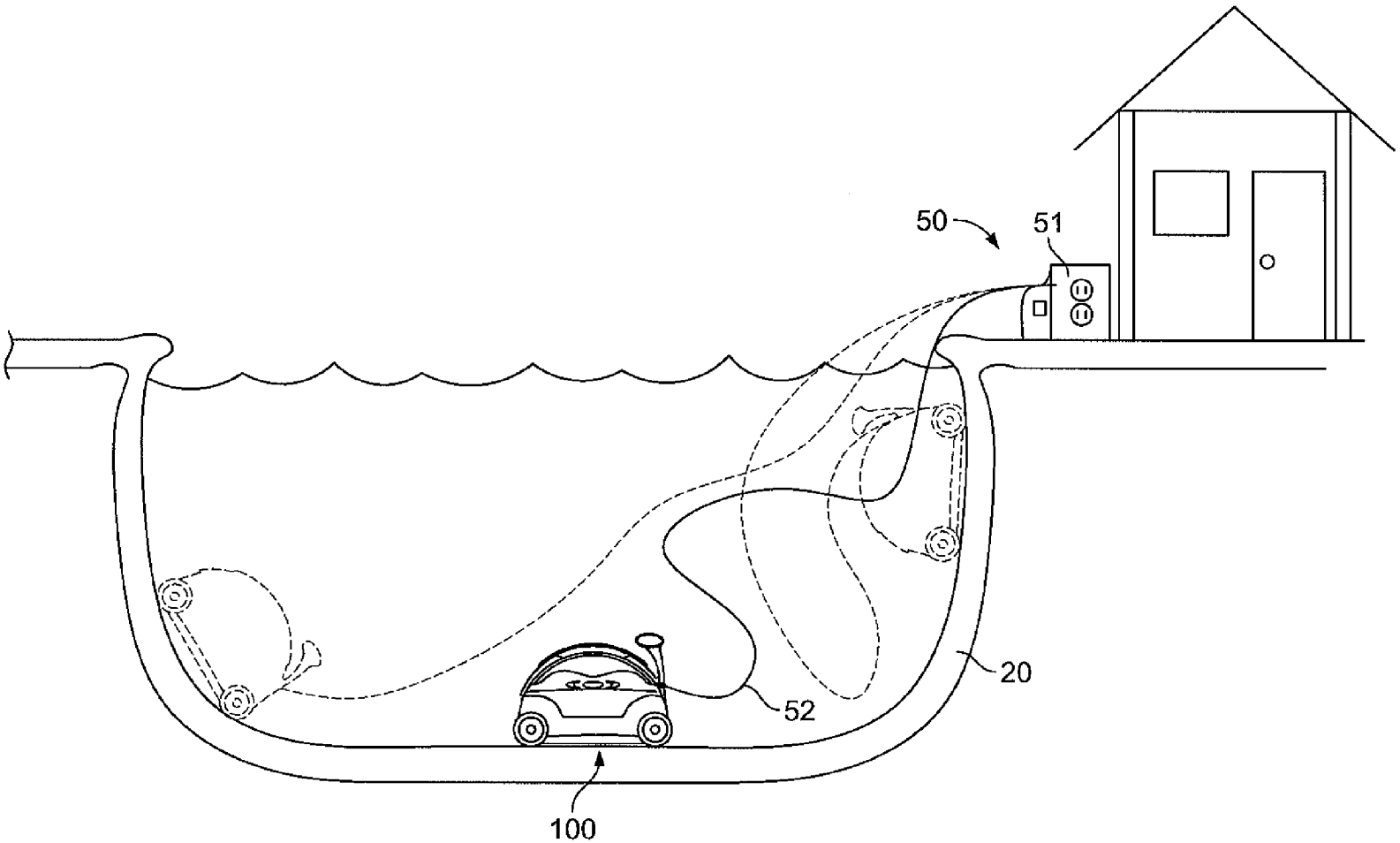
FIG. 19 depicts the exemplary cleaner assembly of FIGS. 1-2 in operation cleaning a pool.

Referring now to FIG. 19, the cleaner 100 of FIGS. 1-8 is depicted cleaning a pool 20. The cleaner 100 is advantageously able to clean both the bottom and side walls of the pool 20 (collectively referred to as the "walls" of the pool 20). The cleaner 100 is depicted as having an external power supply including a transformer/control box 51 and a power cable 52.

Figure 20:
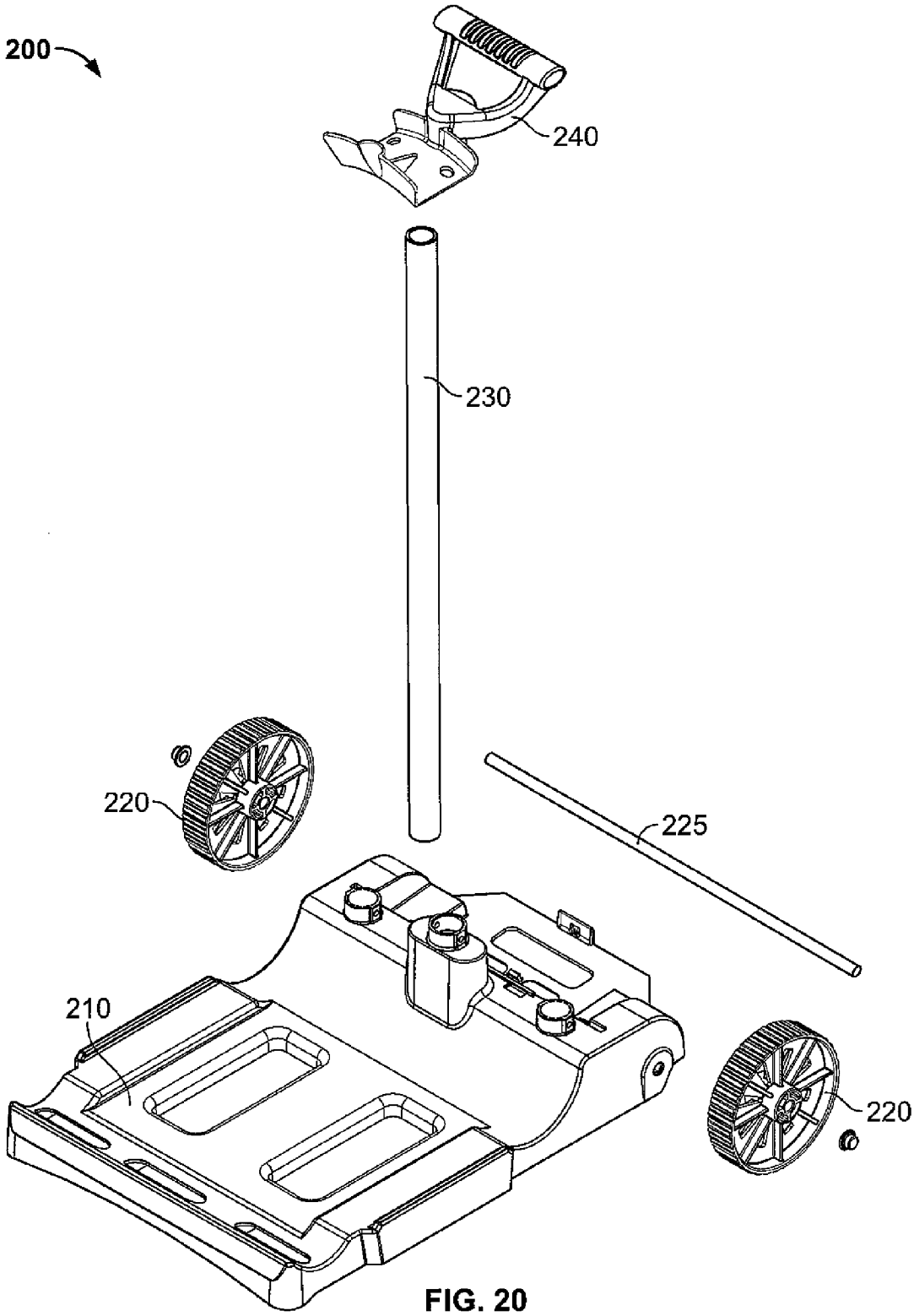
FIG. 20 depicts a perspective view of an exemplary caddy for the cleaner of FIGS. 1-8.
Figure 21:
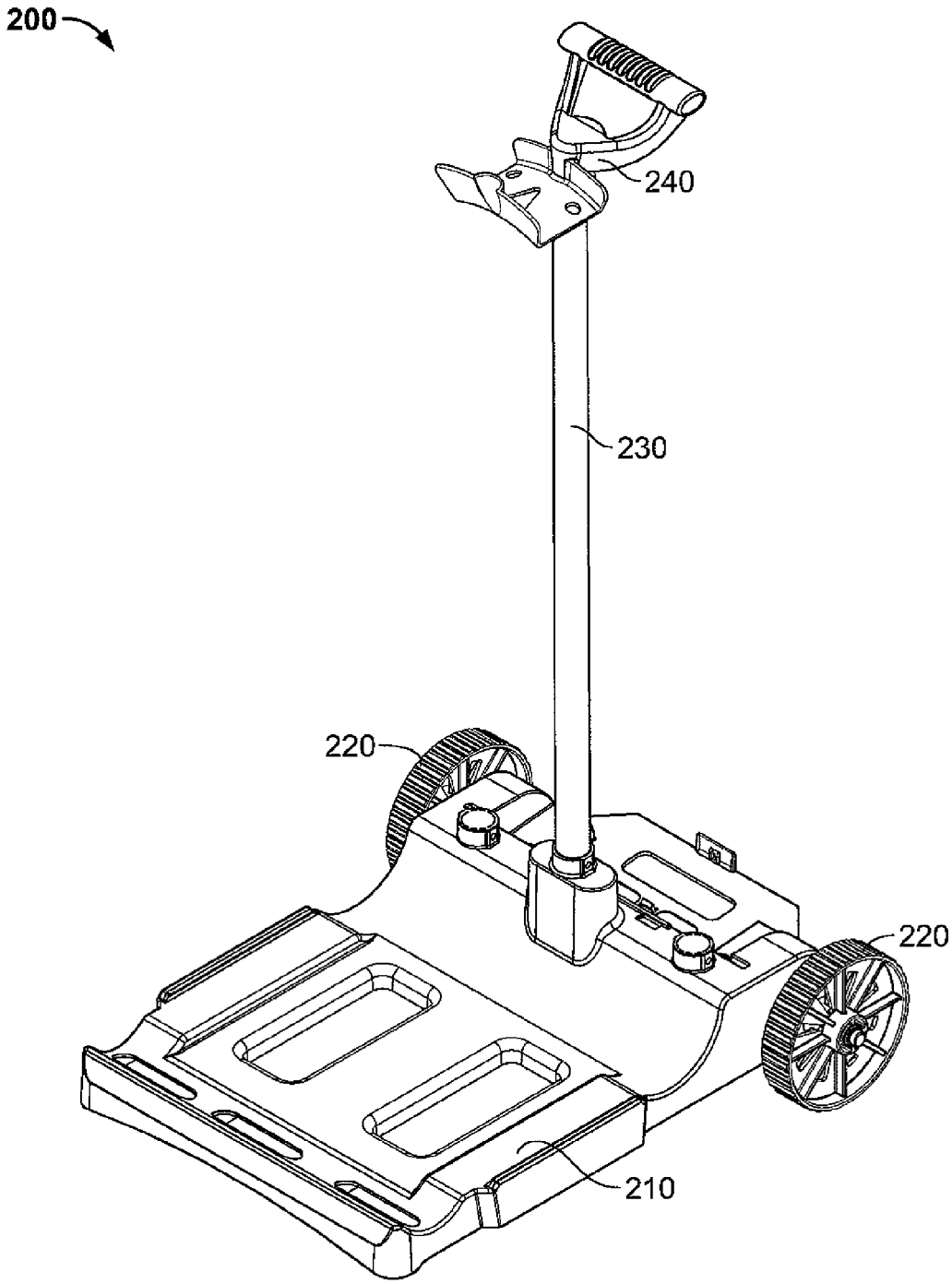
FIG. 21 depicts an exploded perspective view of the caddy of FIG. 20.

Referring now to FIGS. 20-21, an exemplary caddy 200 for the cleaner 100 of FIG. 1-8 is depicted. The caddy 200 can includes a support shelf 210 (configured and dimensioned to correspond with the bottom of the cleaner 100), wheel assemblies 220 (rotationally associated with the support shelf 210 by means of an axel 225), an extension 230, and a handle 240. In general the caddy 200 is used to facilitate transporting the cleaner, e.g., from a pool to a storage shed.

Referring now to FIGS. 1-21, an exemplary method for using the cleaner assembly 10 is presented according to the present disclosure. The power supply 50 of the cleaner assembly 10 is plugged in and the cleaner 100 of the cleaner assembly 10 is carried to the pool 20 and gently dropped there-into, e.g., using the cleaner handle 114 and or caddy 200. Note that the power cable 52 of the power supply 50 trails behind the cleaner 100. After the cleaner 100 has come to a rest on the bottom of the pool 20, the cleaner assembly 10 is switched on using the transformer/control box 51. The transformer/control box 51 transforms a 120 VAC or 240 VAC (alternating current) input into a 24 VDC (direct current) output, respectively. The 24 VDC is communicated to the motor drive assembly 160 via the power cable 52, wherein it powers a gear motor associated with the one or more drive shafts 166 and a pump motor associated with the impeller 162C. Note that in exemplary embodiments, the motor drive assembly 160 may include a water detect switch for automatically switching the gear motor and pump motor off when the cleaner 100 is not in the water. The motor drive assembly can include hardwired (or other) logic for guiding the path of the cleaner 100.

The gear motor drives the wheel assemblies 130 and the roller assemblies 140. More particularly, the gear motor powers one or more drive shafts 166, which drive the drive belts 165. The drive belts 165 drive the bushing assemblies 135. The bushing assemblies 135 turn axels 143B, and the axels 143B rotate the wheel assemblies 130 and the rollers 141 of the roller assemblies 140. The cleaner 100 is propelled forward and backward while scrubbing the bottom of the pool 20 with the rollers 141.

The motor drive assembly 160 can include a tilt switch for automatically navigating the cleaner 100 around the pool 20, and U.S. Pat. No. 7,118,632, the contents of which are incorporated herein for all permissible purposes, discloses tilt features that can be advantageously incorporated.

The primary function of the pump motor is to power the impeller 162C and draw water through the filter assembly 150 for filtration. More particularly, unfiltered water and debris are drawn via the intake apertures 113 of the housing assembly 100 through the intake channels 153 of the filter assembly 150 and into the one or more bucket-shaped intake flow regions 157, wherein the debris and other particles are trapped. The water then filters into the one or more vent flow regions 158. With reference to FIG. 11, the flow path between the intake flow regions 157 and the vent flow regions 158 can be through the side filter panels 154 and/or through the top filter panels 155. The filtered water from the vent flow regions 158 is drawn through the intake openings defined by the apertured support 162A of the impeller 162C and discharged via the filtration vent shaft.

A user may from time-to-time look through the windows 124 of the lid assembly 120 to confirm that the filter assembly 150 is working and/or to check if the intake flow regions 157 are to be cleaned of debris. If it is determined that maintenance is required, the filter assembly 150 is easily accessed via the top of the cleaner 100 by moving the lid assembly 120 to the open position. The filter assembly 150 (including the body 151, frame 156, and filter elements) may be removed from the base 111 of the cleaner 100 using the filter handles 151(C). The user can use the facially accessible quick-release mechanism to remove the rollers 141 from the cleaner 100 by simple release of the radially-extending fastener 144. The roller 141 can be cleaned and/or replaced.

While various embodiments of the invention have been described herein, it should be apparent, however, that various modifications, alterations and adaptations to those embodiments may occur to persons skilled in the art with the attainment of some or all of the advantages of the present invention. The disclosed embodiments are therefore intended to include all such modifications, alterations and adaptations without departing from the scope and spirit of the present invention as set forth in the appended claims.

What is claimed is:

1. A top-accessible pool cleaner, comprising:

(a) a housing assembly having a closable top opening;

(b) a bucket-type filter assembly configured to be removably received by said housing assembly, said bucket type filter assembly including at least one intake channel for receiving unfiltered fluid and a vent channel for outflow of filtered fluid; and (c) a motor, said bucket-type filter assembly including (i) a frame over said motor between said closable top opening and said motor, (ii) a body, and (iii) at least one filter element in secured arrangement with said frame, said at least one filter element cooperating with said body to define at least one intake flow region configured for fluid communication with said at least one intake channel, said at least one filter element at least partially defining a vent flow region configured for fluid communication with said vent channel; wherein said body has a saddle-shaped elevation.

2. The pool cleaner of claim 1, wherein said at least one filter element, includes a plurality of filter elements defining said vent flow region therebetween.

3. The pool cleaner of claim 1, wherein said filter assembly includes a handle for lifting said filter assembly out from said housing assembly.

4. The pool cleaner of claim 1, comprising a roller assembly and a fluid passage (i) defined through said housing assembly and said filter assembly proximal said roller assembly and (ii) in fluid communication with said at least one intake region.

5. The pool cleaner of claim 1, wherein said at least one filter element includes a plurality of cartridge filters.

6. The pool cleaner of claim 1, including a lid movable between a first position allowing said filter assembly to be removably lifted out from said housing assembly and a second position further defining said at least one intake flow region.

7. A cleaner for use at least on a swimming pool or spa bottom and that provides for access to an interior of the cleaner through a top thereof, the cleaner comprising:

(a) a housing assembly including (i) a cleaner bottom wall with an intake aperture for receiving fluid to be filtered from a swimming pool or spa bottom, and (ii) a closable top opening;

(b) a motor; and (c) a filter assembly configured to be removably received by said housing assembly through said closable top opening, said filter assembly including:

(i) a body with an intake channel for receiving fluid to be filtered from said intake aperture;

(ii) a first filter element having a top and configured to extend transversely with respect to said cleaner bottom wall and cooperate with said body to at least partially define an intake flow region for receiving fluid to be filtered from said intake channel;

(iii) a second filter element configured to face a direction toward said cleaner bottom wall and to extend along an elevation proximal said top of said first filter element, said second filter element cooperating with said first filter element to at least partially define a vent flow region configured to receive filtered fluid from said intake flow region; and (iv) a frame over said motor between said closable top opening and said motor and configured to support said first and second filter elements.

8. The cleaner of claim 7, wherein said first filter element comprises a cartridge filter.

9. The cleaner of claim 7, wherein said filter assembly includes at least one finger element removably securing said first filter element with said frame.

10. The cleaner of claim 7, wherein said frame includes a frame member configured to extend transversely with respect to said cleaner bottom to support said first filter element.

11. The cleaner of claim 10, wherein said first filter element is removably securable to said frame.

12. The cleaner of claim 10, wherein said frame includes a second frame member configured to support said second filter element.

13. The cleaner of claim 12, wherein said second frame member is configured to support said second filter element.

14. The cleaner of claim 12, wherein said second frame member of said removable filter assembly defines a vent channel configured to exhaust filtered fluid from said vent flow region.

15. The cleaner of claim 7, wherein said cleaner bottom wall defines a second intake aperture and said body defines a second intake channel configured to receive fluid to be filtered from said second intake aperture.

16. The cleaner of claim 15, comprising a third filter element configured to extend transversely with respect to said cleaner bottom wall and cooperate with said body to at least partially define a second intake flow region configured to receive fluid to be filtered from said second intake channel.

17. The cleaner of claim 7, including a hinge and a lid movable about said hinge between an open position allowing said filter assembly to be removably lifted out from said housing assembly and a closed position in which said lid further defines said intake flow region.

18. The cleaner of claim 17, wherein said lid has first and second opposing ends, wherein said hinge is proximal said first end, and wherein said second end is provided with a latch mechanism with a button.

19. The cleaner of claim 7, including a handle for lifting up said filter assembly out from said housing assembly.

20. The cleaner of claim 7, wherein said frame is integral with said body.

21. The cleaner of claim 20, wherein said vent flow region is between said first filter element and said second filter element.

22. The cleaner of claim 21, wherein said first filter element comprises a cartridge filter.

23. The cleaner of claim 21, wherein said filter assembly includes at least one finger element removably securing said first filter element with said frame.

24. The cleaner of claim 21, wherein said frame includes a frame member configured to extend transversely with respect to said cleaner bottom to support said first filter element.

25. The cleaner of claim 24, wherein said first filter element is removably securable to said frame.

26. The cleaner of claim 24, wherein said frame includes a second frame member configured to support said second filter element.

27. The cleaner of claim 26, wherein said second frame member is configured to support said second filter element.

28. The cleaner of claim 26, wherein said second frame member of said removable filter assembly defines a vent channel configured to exhaust filtered fluid from said vent flow region.

29. The cleaner of claim 21, wherein said cleaner bottom wall defines a second intake aperture and said body defines a second intake channel configured to receive fluid to be filtered from said second intake aperture.

30. The cleaner of claim 29, comprising a third filter element configured to extend transversely with respect to said cleaner bottom wall and cooperate with said body to at least partially define a second intake flow region configured to receive fluid to be filtered from said second intake channel.

31. The cleaner of claim 21, including a hinge and a lid movable about said hinge between an open position allowing said filter assembly to be removably lifted out from said housing assembly and a closed position in which said lid further defines said intake flow region.

32. The cleaner of claim 31, wherein said lid has first and second opposing ends, wherein said hinge is proximal said first end, and wherein said second end is provided with a latch mechanism with a button.

33. The cleaner of claim 21, including a handle for lifting up said filter assembly out from said housing assembly.

34. The cleaner of claim 7, wherein said filter elements are formed of mesh with holes defined therethrough.

35. The cleaner of claim 7, wherein said motor is positioned in said vent flow region at least partially between said cleaner bottom wall and said second filter element.

36. The cleaner of claim 7, including a hinge and a lid movable about said hinge between an open position allowing said filter assembly to be removably lifted out from said housing assembly and a closed position.

37. The cleaner of claim 7, wherein said filter elements are removable with respect to said body.

38. The cleaner of claim 7, wherein said frame is sized and dimensioned to fit over a motor drive assembly including said motor to divide said vent flow region into a plurality of vent flow regions.

* * * * *

UNITED STATES PATENT AND TRADEMARK OFFICE

CERTIFICATE OF CORRECTION

PATENT NO. : 8,343,339 B2
APPLICATION NO. : 12/211720
DATED : January 1, 2013
INVENTOR(S) : Jirawat Sumonthee It is certified that error appears in the above-identified patent and that said Letters Patent is hereby corrected as shown below:

Title Page 2, Item (56) of the cited references, "4,533,945" should be -- 4,553,945 --;

Title Page 4 of the cited references, first column:

"Dolphin Cleaner photos (3 pages) and Dolphin Cleaner p. (2 pages) (Cleaner seen at a show circa Oct. 2009)." should be -- Dolphin Cleaner photos (3 pages) and Dolphin Cleaner page (2 pages) (Cleaner seen at a show circa Oct. 2009) Exact Date Unknown --;

At the end of Polaris 9300 and Vortex 3 Cleaners (manuals dated Copyright 2010 and V3 cleaner seen at a show circa Oct. 2009) (125 pages)., insert -- Exact Date Unknown --;

Title Page 4 of the cited references, second column:

Insert -- Patent -- after "U.S." in: Co-owned U.S. Appl. No. 12/938,041 entitled "Pool Cleaning Device with Adjustable Buoyant Element," filed on Nov. 2, 2010 (99 pages).

Insert -- Patent -- after "U.S. Design" in: Co-owned U.S. Design Appl. No. 29/378,304 entitled "Pool Cleaner" filed on Nov. 2, 2010 (8 pages).

In the reference: In You Tube Video of Mopper Cleaner, http://www.youtube.com/watch?v=d8NAUWHOQCk&feature=BFa&list=ULopZLfx7W4Po, e.g., attached screen shots (45 pages) uploaded Nov. 18, 2009., "d8NAUWHOQCk" should be -- d8NAUWH0QCk --.

Signed and Sealed this
Sixteenth Day of July, 2013

Teresa Stanek Rea

Teresa Stanek Rea
*Acting Director of the United States Patent and Trademark Office*